US008727392B2

(12) United States Patent
Greiner et al.

(10) Patent No.: US 8,727,392 B2
(45) Date of Patent: May 20, 2014

(54) CONVERTIBLE MOTORIZED LATCH

(75) Inventors: Matthew R. Greiner, Simpsonville, SC (US); Kenneth A. Kaczmarz, LaGrange Park, IL (US); Mitchell S. Mlynarczyk, Hoffman Estates, IL (US); Kenneth D. Graw, Streamwood, IL (US); Francis H. Zimmerman, Libertyville, IL (US)

(73) Assignee: CompX International Inc., Greenville, SC (US)

( * ) Notice: Subject to any disclaimer, the term of this patent is extended or adjusted under 35 U.S.C. 154(b) by 24 days.

(21) Appl. No.: 13/282,573

(22) Filed: Oct. 27, 2011

(65) Prior Publication Data

US 2012/0038177 A1 Feb. 16, 2012

Related U.S. Application Data

(62) Division of application No. 11/904,297, filed on Sep. 26, 2007, now Pat. No. 8,403,376.

(60) Provisional application No. 60/934,308, filed on Jun. 12, 2007.

(51) Int. Cl.
*E05C 1/06* (2006.01)
*E05C 1/12* (2006.01)

(52) U.S. Cl.
USPC ..... 292/157; 292/144; 292/164; 292/169

(58) Field of Classification Search
USPC ..... 292/157, 144, 169.14, 169.19, 137, 292/163–176
See application file for complete search history.

(56) References Cited

U.S. PATENT DOCUMENTS

| | | | | |
|---|---|---|---|---|
| 4,593,543 | A | 6/1986 | Stefanek | |
| 4,656,850 | A | 4/1987 | Tabata | |
| 5,666,830 | A | 9/1997 | Litvin | |
| 5,862,692 | A * | 1/1999 | Legault et al. | 70/278.1 |
| 5,927,769 | A | 7/1999 | Pullen | |
| 6,546,769 | B2 | 4/2003 | Miller et al. | |
| 6,732,557 | B1 * | 5/2004 | Zehrung | 70/283 |
| 7,059,159 | B2 | 6/2006 | Lanigan et al. | |
| 7,240,524 | B1 | 7/2007 | White et al. | |
| 7,263,865 | B2 * | 9/2007 | Miller et al. | 70/303 A |
| 7,647,797 | B1 * | 1/2010 | Viso Cabrera et al. | 70/208 |
| 8,403,376 | B2 * | 3/2013 | Greiner et al. | 292/144 |
| 2010/0237636 | A1 * | 9/2010 | Juga et al. | 292/341 |

* cited by examiner

*Primary Examiner* — Mark Williams
(74) *Attorney, Agent, or Firm* — Dority & Manning, P.A.

(57) ABSTRACT

Disclosed is a convertible motorized latch that may be configured in either of a slam latch or a dead bolt latch configuration, just by desired selection and replacement of a minimal number of components, and which may be used on new (oem) equipment or in retrofit applications. In either preferred configuration, an electric motor contained within the latch housing operates to open or unlock the latch. Latch closure may be provided by spring actuation in a slam configuration or by further motor operation in a dead bolt configuration. Either present configuration may make use of an electrical feedback switch for signaling latch retraction while the dead bolt configuration may also include a second electrical feedback switch for signaling latch extension. A gear train may be incorporated within the latch housing to provide reduced speed and increased torque from the electric motor.

4 Claims, 26 Drawing Sheets

CONVERTIBLE MOTORIZED LATCH

PRIORITY CLAIM

This application is a divisional of prior pending U.S. patent application Ser. No. 11/904,297 filed Sep. 26, 2007 entitled "CONVERTIBLE MOTORIZED LATCH", which claims the benefit of previously filed U.S. Provisional Patent Application of the same title assigned U.S. Ser. No. 60/934,308, as filed Jun. 12, 2007, which are hereby incorporated herein by reference in their entireties for all purposes. Any disclaimer that may have occurred during prosecution of the above-referenced application(s) is hereby expressly rescinded.

FIELD OF THE INVENTION

The present subject matter relates to an enclosure locking latch mechanism. More particularly, the present subject matter relates to a latch mechanism that may be configured to provide either a slam latch or dead bolt latch type action, and used with either new (oem) equipment or retrofit applications. In either such configuration, an electric motor may be included within a latch housing and operative to open or unlock the latch.

BACKGROUND OF THE INVENTION

Many occasions arise that require electronic access control of different types of cabinets, entryway doors, carts, tool boxes, and other types of boxes, hereafter regardless generally of their compositions, materials, or configurations collectively referred to as an enclosure or cabinet. Such enclosures or cabinets may be provided with doors and/or may also include drawers.

The need for access control usually arises from the lack of security often provided by typical lock and key mechanisms. For example, a mechanical key may be lost or stolen. Once such a lost or stolen key has been surreptitiously obtained by an unauthorized individual, such individual in possession of such key may easily access the secured enclosure to either steal its contents or, as in the case of secured medical records or other confidential documents, view its contents. Further, when such enclosures or cabinets are accessed, there is typically no record that it has been accessed, let alone who accessed it or when such access took place.

Such shortcomings of keyed mechanical locks have contributed to the creation of the specialized field of electronic access control.

Typically, electronic access control may correspond to a three part system, including, for example: (1) a credential reader, (2) a microprocessor based control circuit, and (3) an electronic latch to mechanically open or unlock the enclosure being secured by the access control system.

Credential readers may include, but are not limited to: keypads, magnetic stripe card readers, proximity card readers, "ibuttons," smart card readers, and/or bar code card readers. In the recent past, there has been significant progress in the field of biometrics that includes, but is not limited to, the ability to reliably read and discern an individual's fingerprints, handprints, and retina and/or facial features.

Generally speaking, credential and/or biometric readers convert their applicable credential or biometric features, respectively, into a binary number. A microprocessor based system then reads and analyzes such binary number. Such systems are typically either standalone (attached to the reader) or networked (attached to many readers). Typically, they may read the binary number that corresponds to the potential entrant's credential or biometric features and compare it to a list of approved binary numbers. In such fashion, the microprocessor based system determines if the potential entrant has the right to access the enclosure or cabinet being secured by the access control system.

If the microprocessor based system determines that the subject credential or biometric feature under consideration is valid, access is granted to the enclosure. Typically, such is accomplished by the microprocessor turning on an electronic control circuit corresponding to a solid state devices or relays which in turn provide a useable electrical voltage to open an electronic latch mechanism. There are generally speaking two primary styles of electronic latch mechanisms: slam latches and dead bolt latches.

Slam latches have a spring loaded locking feature or slam bolt, allowing for the door of the enclosure to be locked by simply pushing or "slamming" the door closed. The slam bolt is easily pushed into the latch body and is provided with a spring return.

Typically, one side of such a slam bolt is provided with a cam surface. The slam latch in general terms is mounted to the interior door surface of a given enclosure such that the cam surface strikes the enclosure frame, which in turn drives the latch's slam bolt into the latch body as the door is closed. Such action charges a return spring. Typically, the inside of the enclosure frame is provided with a locking surface against which the slam bolt locks. Once the enclosure door is closed, the charged return spring extends the slam bolt, locking the enclosure.

Dead bolt latches utilize a fixed dead bolt without means of a spring return. Such types of latches instead require the electronic control circuit to actuate a motor or solenoid to alternately retract and/or extend the dead bolt in order to provide the locking (or unlocking) action. In other words, a locking action is not "automatic" when the enclosure door is closed.

The dead bolt in the above-referenced type of latch mechanism is typically provided with a square or rectangular end (though alternatives may be practiced). A latch utilizing such type of bolt is generally speaking in at least one sense more secure than a slam latch because it needs to receive a credentialed (i.e., authorized) signal in order for the dead bolt to be retracted. In comparison, the bolt of a slam latch may simply be pushed in. Such "pressing in" action can be done by a thief after employing dishonest means to access the enclosure being secured by the slam bolt. However, the corresponding adverse or negative aspect of the dead bolt type latch is that an enclosure door cannot simply be slammed closed. The latch must receive a signal from the access control system to extend the dead bolt at the correct time.

It is a fairly common occurrence in the field that such latches will have some locking force applied to them in a direction which is perpendicular to the bolt surface. Such force can be the result of a variety of influences and/or conditions, for example, improperly installed latches, racked or twisted cabinets, swollen door materials (for example, wood), articles inside the enclosure falling against the inside of the door, and/or from an enclosure being "over stuffed". Such a "pre-load" on the latch bolt may in some instances be relatively significant, for example, on the order of several pounds.

The prime mover in the types of latches presently addressed are typically either a solenoid or a motor/gear train combination. Solenoid based latches having equal strength to a given motor/gear train based latch are significantly larger and heavier than such "equivalent" motor/gear train design. Latches constructed in accordance with the present subject matter are motor based.

Motor/gear train based slam latches present a design challenge in that during the slam action, the locking bolt needs to be disconnected from the gear train. If such aspect is not properly provided or accomplished, it may have a detrimental affect on the reliability of the gear train and latch.

It is further desirable from a manufacturing and business point of view to have a latch that is easily assembled as either a slam latch or a dead bolt latch configuration, depending on the simple addition/deletion of a minimal number of parts.

While various implementations of enclosure locking mechanisms have been developed, no design has emerged that generally encompasses all of the desired characteristics as hereafter presented in accordance with the subject technology.

SUMMARY OF THE INVENTION

The present subject matter is directed to a motorized latch mechanism. More particularly, the present subject matter is directed to a motorized latch mechanism which may be embodied as either a slam latch or a dead bolt latch with minimal changes in the number of parts employed in the latch mechanism, and which may be used either on new (oem) equipment or in retrofit applications. By such minimized parts changes, differing embodiments of the present subject matter may be provided, resulting in the selection of differing latch bolt behavior in the extended or locked state.

A slam latch embodiment of the present subject matter preferably includes a spring loaded locking bolt with an angled cam surface. Such slam bolt is easily pushed into the main latch body and is provided with a spring return. The standard mode of operation for such type of latch is to have the cam surface of the slam bolt contact a metal strike on the enclosure frame during the door close action. The present motorized latch is typically mounted to the moving door of the enclosure. Such striking action causes the slam bolt to enter the main latch body, compressing (i.e., charging) a return spring. Once the slam bolt has entered the main latch body, the enclosure door can close and the return spring can re-extend the slam bolt, which in turn locks behind the enclosure frame.

The action of the dead bolt latch embodiment of the present subject matter is similar except that the dead bolt is not spring loaded and requires the action of the motor to extend the dead bolt. The present dead bolt latch design provides a relatively higher level of security as the locking bolt is never disengaged from the gear train and thus cannot simply be pushed into the latch body. Such additional level of security nonetheless comes at the price of inconvenience as it requires the user to "tell" the system to extend the dead bolt, whereas the slam latch simply requires the user to "slam" the door.

The present subject matter corresponds to a latch mechanism that, with the simple addition or removal of a minimal number of parts can be assembled as either a slam latch or a dead bolt latch. The provision of such a convertible latch mechanism is desirable from a business perspective as only one set of latch parts needs to be tooled and maintained. Further, it is desirable from a manufacturing point of view as only one assembly line must be set up and maintained.

Although from a business standpoint, it is not necessarily expected for the latch mechanism described herein to be field changeable from one latch type to the other, such a field conversion is structurally possible and presents yet another significant benefit of the present subject matter.

A motorized latch constructed in accordance with the present subject matter may be provided with an electrical connector for connecting the motorized latch to an access control system. As referenced above, access control systems require a user to present a credential to a credential reader. Credential readers which may be practiced with the present subject matter include for example, but are not limited to, keypads, magnetic stripe card readers, proximity card readers, "ibuttons," smart card readers, and/or bar code card readers. In addition to credentials, the access control system may also (or alternatively) be provided with the ability to read an individual's biometric data including, but not limited to, fingerprints, hand prints, and retina and/or facial features. All such variations may be practiced in conjunction with embodiments of the present subject matter.

In either case, the credential, including biometrics, is read and checked against one or more valid credentials. If the access control system decides that the credential is valid, it will "tell" the motorized latch to open. Typically, such may be accomplished by a solid state control circuit providing a low voltage electrical signal to the latch. Such electrical signal is transmitted through related wiring and connectors to the electrical connector on the motorized latch.

In the present exemplary embodiments, such an electrical connector is provided with terminals and wiring connecting it to a motor. The shaft of such exemplary motor is connected to a gear train, consisting of a plurality of gears, which acts to both reduce the speed of the motor while increasing its output torque, as well understood by those of ordinary skill in the art.

The end of such exemplary gear train may be connected to an output cam pin. Such cam pin engages a tab on one end of a slide. The opposite end of the slide may also have a tabbed feature which in turn engages the latch bolt.

In the present slam latch configuration, as the bolt is retracted, a return spring is charged. There is an additional tab on the slam bolt which contacts an electrical switch when the slam bolt is fully retracted. Such switch (which may be presently referred to as a latch retracted feedback switch) is electrically connected to the same access control system through the same wires, connectors, and the like as is the motor. When the latch retracted feedback switch is closed, by the slam bolt reaching the retracted position, the access control system preferably turns off the motor. Such preferred present operation allows time for the entrant to open the enclosure door.

After some time, which per the present subject matter may be adjustable by the latch owner, the access control system turns the motor back on. The output cam pin then rotates off of the tabbed feature on the slide, allowing the slide to move freely. The charged return spring then pushes the slam bolt out of the main latch body, pulling the slide with it. Such action also preferably per the present subject matter disengages the slam bolt from the latch retracted feedback switch so that the switch is now open. The access control system "sees" the switch open and, therefore knows that the latch's slam bolt has released, and it turns the motor off. As previously described, the bolt is again in the extended, spring loaded state and is easily pushed back into the main latch body when the cam surface on the slam bolt strikes the enclosure frame during the door closing action.

By contrast, when the bolt is retracted in the dead bolt latch configuration of the present subject matter, there is no return spring being charged. The dead bolt latch is also provided with the present latch retracted feedback switch. However, in addition to such switch, the dead bolt latch is provided with a second switch, the presently referenced latch extended feedback switch. Such latch extended feedback switch in essence "tells" the present access control system that the dead bolt is fully extended. Such information from the latch extended feedback switch is significant as the dead bolt does not spring-return to a fixed position in the dead bolt latch configuration.

The access control system needs to know when the dead bolt is fully extended in order to turn off the motor at the correct time.

While the dead bolt retract action is identical to that of the slam latch design, that of the latch extend differs greatly, per present features. When the output cam pin rotates off the tabbed feature on the slide, the slide is still allowed to move freely. However, since there is no return spring, the dead bolt (although now uncoupled from the gear train) does not move. As the motor continues to run, the cam pin contacts the front tab of the slide. In the dead bolt latch configuration, the slide is preferably provided with an additional dead bolt pin. As the slide is pushed forward, the dead bolt pin on the slide in turn pushes the dead bolt out of the latch body. Such action also removes the dead bolt from closing the latch retracted feedback switch and causes it to instead close the latch extended feedback switch. The access control system "sees" the latch extended feedback switch close, and therefore knows that the dead bolt has fully extended, and further therefore turns the motor back off. The dead bolt is now fully extended and cannot be pushed back in, as it is being blocked by the dead bolt pin on the slide and in turn blocked by the output cam pin on the end of the gear train. The dead bolt extension action must occur after the enclosure door is in the closed position. If the extension action is performed before the door is closed, the dead bolt will have to be retracted again before closing.

In accordance with the present subject matter, the exemplary four parts that with their respective addition or deletion allow the latch to be easily alternatively assembled in either of the slam or dead bolt configurations are preferably the return spring, the spring guide, the dead bolt pin, and the latch extended feedback switch.

One present exemplary embodiment relates to a convertible latch having a housing, a latch bolt, a drive mechanism, and at least one electrical switch. Such latch bolt is preferably mounted at least partially within such housing for selected alternate extension from such housing and retraction into such housing. Such exemplary drive mechanism is preferably configured to selectively retract such latch bolt into such housing, while such at least one electrical switch is preferably mounted within such housing and positioned such that such switch is operated by such latch bolt upon retraction of such latch bolt into the housing.

In exemplary variations of the foregoing, such drive mechanism may comprise an electrically operated drive mechanism including an electrically operated motor and an associated drive mechanism output. In some embodiments, such drive mechanism output may include a gear train, an output cam, and an output cam pin. In still further present alternatives, an electrical connector may be mounted to such housing, so as to provide electrical connections to an electrically operated drive mechanism and an electrical switch.

In still further present exemplary embodiments, a convertible latch kit may be provided including various components for selective assembly. Such a present exemplary kit may include a housing, an electrically operated drive mechanism mounted in such housing and having an associated drive mechanism output, a slam bolt configured to be mounted in such housing and to be retracted by such drive mechanism output, a spring configured to-be cooperatively engageable with such slam bolt to provide a force thereto in the direction of extending such slam bolt from such housing, and a dead bolt configured to be mounted in such housing and to be selectively alternately retracted and extended by such drive mechanism output.

In a still further present exemplary embodiment, a convertible motorized latch may be configured in either of a slam latch or a dead bolt latch configuration, for use with a cabinet of the type having an alternately openable and closeable door. Such latch may comprise a latch housing, configured to be supported on the a door of a cabinet, on the inside of such cabinet; a latch bolt associated with such latch housing, and configured for alternately assuming retracted and extended positions relative to such housing; an electric motor contained within such latch housing, and operative when actuated to unlock such latch bolt by moving it into a retracted position thereof; a geared output incorporated within such latch housing and associated with such electric motor so as to provide reduced speed and increased torque therefrom; and an electrical feedback switch for signaling latch bolt retraction.

Still further, certain present embodiments may equally relate to corresponding methodologies. One such exemplary methodology relates to providing controlled access to a cabinet of the type having an alternately openable and closeable door for unlocking and locking thereof. Such exemplary method may comprise providing a convertible latch kit including components for selective assembly (such as the above referenced example thereof), determining whether such cabinet is of the type having an associated strike plate supported on a frame thereof, for use with a slam bolt configuration, or of the type having a recessed area formed in a frame thereof, for use with a dead bolt thereof; depending on such determination, selecting accordingly either of such slam bolt or dead bolt, respectively, for inclusion in such housing; and mounting such housing in such cabinet, supported on the door thereof and positioned so that the included bolt of such housing is interoperative with the frame of such cabinet for alternate locking and unlocking of the cabinet door.

Such exemplary method may further include additional aspects, forming yet further present methods. For example, additional steps may include mounting an electrical connector in such housing and configured to provide electrical connection to said electrically operated drive mechanism; while also providing said drive mechanism output with a gear train, an output cam, an output cam pin, a slide engageable with either of said slam bolt or said dead bolt, and a slide tab coupled to said slide and configured for engagement with said cam pin. Still further potential alternatives may include mounting at least one electrical switch in such housing and coupled to said electrical connector so as to sense movement of one of said slam bolt and said dead bolt mounted in said housing. Yet additional steps may include further mounting a second electrical switch in such housing and coupled to said electrical connector so as to further sense movement of one of said slam bolt and said dead bolt mounted in said housing. Still other aspects may include providing an external access control device attached to said electrical connector, for controlling said electrically operated drive mechanism for alternately unlocking and relocking said door through actuation of said drive mechanism, said control device including an automatic pre-programmed time delay for relocking said door after unlocking thereof.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the present subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents including combinations of features, parts, or steps or configurations thereof not expressly shown in the figures or stated in the detailed description of such figures. Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 25 illustrates various exemplary aspects of the dead bolt action of an exemplary dead bolt latch constructed in accordance with the present subject matter, and illustrated similar in view to that as in present FIGS. 24*a* and 24*b*, but including (but not limited to) illustration of the output cam pin completing the extension of the exemplary slide and dead bolt, per present subject matter;

Figure 1:
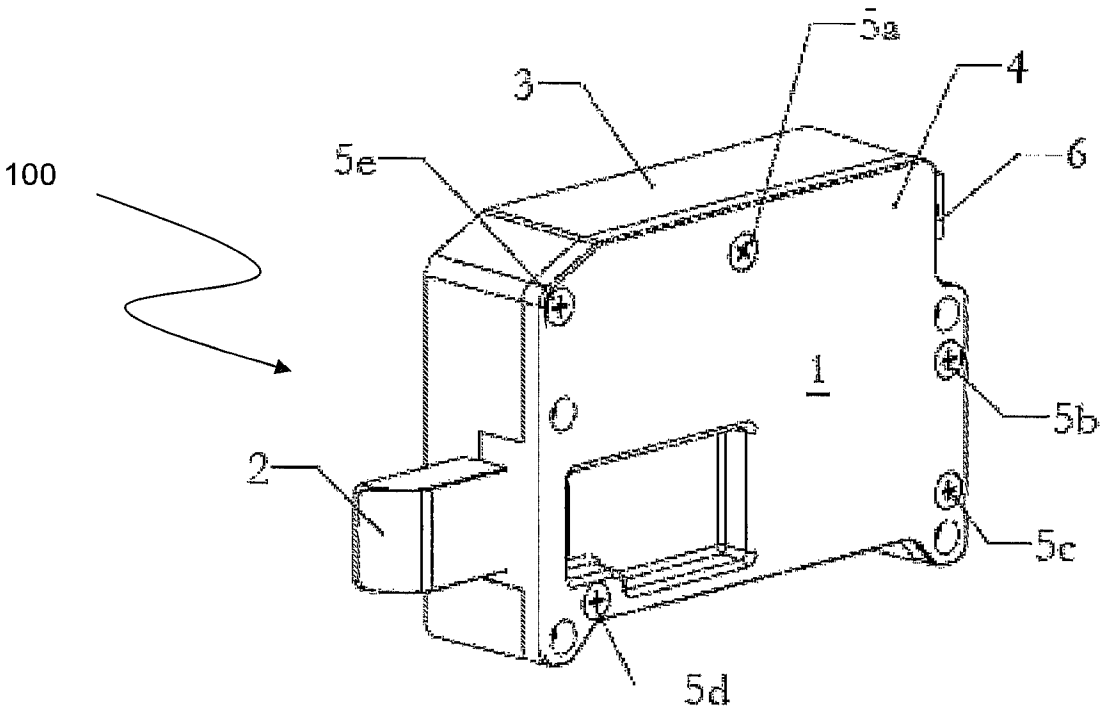
FIG. 1 is a perspective view of an exemplary slam latch constructed in accordance with the present subject matter, and illustrating the exemplary latch thereof with the slam bolt thereof extended.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with a motorized latch mechanism that may be variously embodied as either of a slam latch or a dead bolt latch.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to the presently preferred embodiments of the subject motorized latch mechanism. Referring now to the drawings, FIG. 1 illustrates a perspective view of an exemplary slam latch 100 constructed in accordance with the present technology. As illustrated in FIG. 1, slam latch 100 is shown with an exemplary slam bolt 2 thereof in an extended position As illustrated in present FIG. 1, slam latch 100 includes a main latch body 1 which includes main housing 3, cover 4, slam bolt 2, and electrical connector 6. Main housing 3 and cover 4 may be secured together by a plurality of respective screws 5*a*, 5*b*, 5*c*, 5*d*, and 5*e*, as illustrated. It should be appreciated by those of ordinary skill in the art that other securing means may be employed including more or less permanent means including welding or pop-rivets depending on the desirability of ready post-manufacture disassembly of housing 3 and cover 4.

Figure 2:
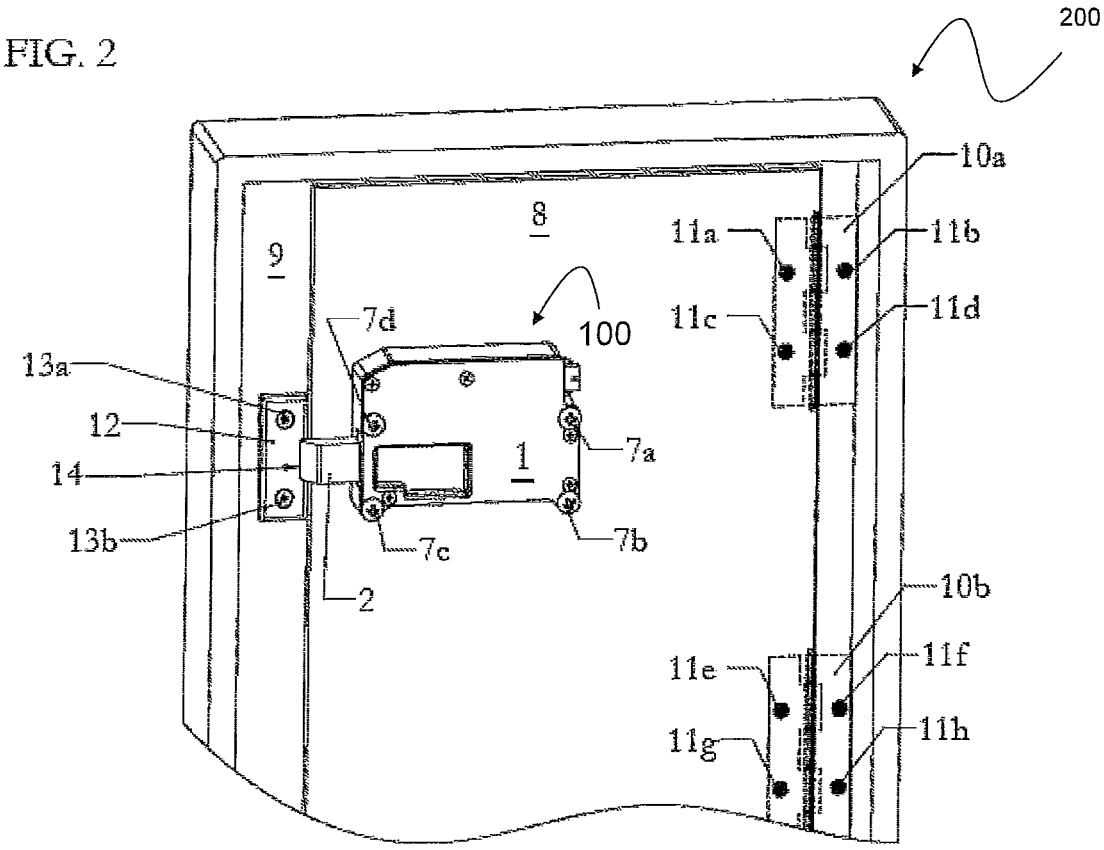
FIG. 2 illustrates the exemplary slam latch of present FIG. 1, in an exemplary installment thereof on an enclosure, illustrated with an exemplary door closed, the slam bolt extended, and the enclosure locked.

FIG. 2 illustrates from within an exemplary cabinet 200 a view of slam latch 100 installed on an exemplary door 8 of such cabinet 200 with door 8 closed and slam bolt 2 extended so that such cabinet 200 is locked. Cabinet 200 corresponds to door 8, which may be variously secured to frame 9, such as rotationally with exemplary hinges 10*a*, 10*b*. Hinges 10*a*, 10*b* may be secured to door 8 and frame 9 by screws 11*a*, 11*b*, 11*c*, 11*d*, 11*e*, 11*f*, 11*g*, and 11*h* or by other suitable means including, but not limited to, welding or pop-rivets. Slam latch 100 may be secured to door 8 with screws 7*a*, 7*b*, 7*c*, and 7*d* or by other suitable means. It is to be understood that the present subject matter is provided without particular limitation as to the precise dimensions or configurations of various enclosures with which the present subject matter may be practiced, so long as such enclosure is "closable" and "openable" in the context of the subject matter otherwise disclosed and discussed herewith.

Exemplary door 8 of such exemplary embodiment may be secured in its determined closed position by the interaction of slam bolt 2 and strike 12 at a point 14. Strike 12 may be secured to cabinet frame 9 with screws 13*a*, 13*b* or other suitable means.

Figure 3:
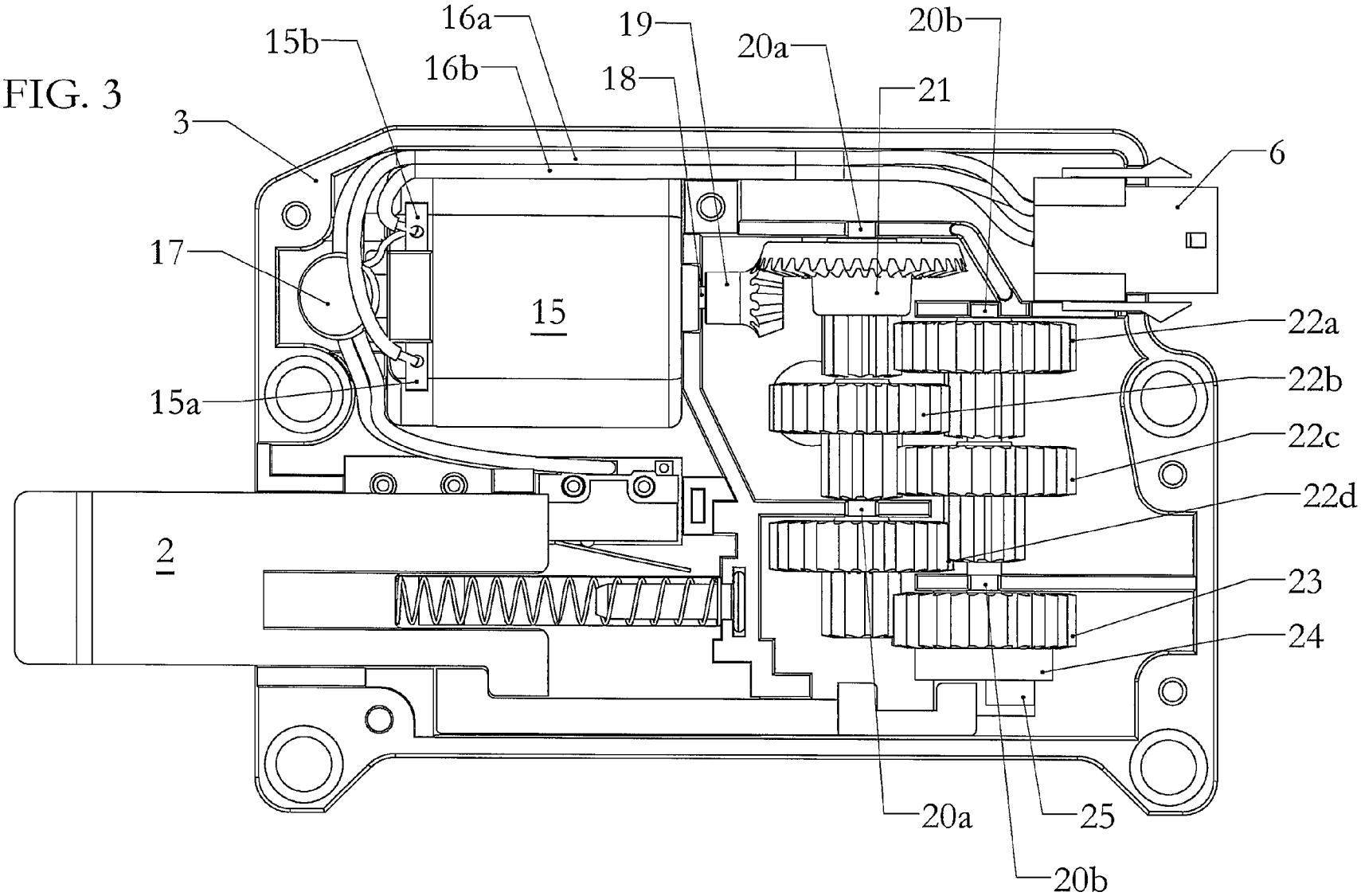
FIG. 3 illustrates an enlarged, partial cutaway, side view of the exemplary slam latch subject matter of present FIG. 1, so as to reveal the internal construction of such exemplary slam latch, constructed in accordance with the present subject matter, and shown with the exemplary slam bolt thereof in an extended position.

FIG. 3 illustrates an enlarged, partial cutaway, side view of the exemplary slam latch subject matter of present FIG. 1, so as to reveal the internal construction of such exemplary slam latch, constructed in accordance with the present subject matter. As illustrated in FIG. 3, slam bolt 2 is shown in an extended position. Slam latch 100 corresponds to multiple components whose collective purpose is to alternately retract or extend slam bolt 2. The prime mover in slam latch 100 is exemplary motor 15. In such illustrated exemplary embodiment, motor 15 may be a permanent magnet DC motor. However, other various types of motors and/or other prime movers could also be employed in accordance with present subject matter, as will be understood by those of ordinary skill in the art without additional detailed discussion as to such aspects.

Exemplary motor 15 as representatively illustrated is contained by a cavity within housing 3, and is provided with exemplary pinion gear 19 which is pressed onto shaft 18 thereof. Pinion gear 19 in turn (in this exemplary embodiment) drives bevel gear 21 which rotates on a shaft 20*a* bounded by slotted walls in housing 3. Bevel gear 21 in turn drives a series of various spur gears 22*a*, 22*b*, 22*c*, 22*d*, and 23. Gears 22*b* and 22*d* also rotate on shaft 20*a*. Gears 22*a*, 22*c*, and 23 rotate preferably on shaft 20*b*, which is also bounded by slotted walls in housing 3. Such overall gear train arrangement collectively provides reduced speed and increased output torque from exemplary motor 15. It is to be understood that variations to such gear train may be practiced per present subject matter. In other words, the present subject matter is not intended as being limited to particular configurations of gear trains.

In an exemplary embodiment, motor 15 may be controlled by a microprocessor based access control system. Such access control system may be electrically connected to slam latch 100 through electrical connector 6. It should be appreciated, however, that other types of control systems, including but not limited to, a simple manually operated electrical switch and power supply could also be used to selectively actuate motor 15.

In the event that an access control system is employed, and upon presentation of a valid credential or biometric to the access control system, power may be supplied to exemplary motor 15 by solid state motor controls and/or electrical relays through connector 6 and the related wiring, as well understood by those of ordinary skill in the art without additional discussion. Electrical connector 6 is connected to motor 15 through motor wires 16*a*, 16*b*, which may be soldered or otherwise secured to motor 15 terminals 15*a*, 15*b*. An electrical interference suppression device 17 may also be connected to terminals 15*a*, 15*b*. In an exemplary embodiment, electrical interference suppression device 17 may correspond to a capacitor. As motor 15 is energized, it rotates gear 19, which in turn rotates gears 21, 22*a*, 22*b*, 22*c*, 22*d*, and 23. The final gear of the gear train, gear 23, is coupled with output cam 24, which is provided with output cam pin 25, all as will be understood by those of ordinary skill from the disclosure herewith.

FIGS. 4, 5*a*, 5*b*, and 6 respectively illustrate the interaction of output cam pin 25 with slide 26 in the present slam latch exemplary embodiment.

Figure 4:
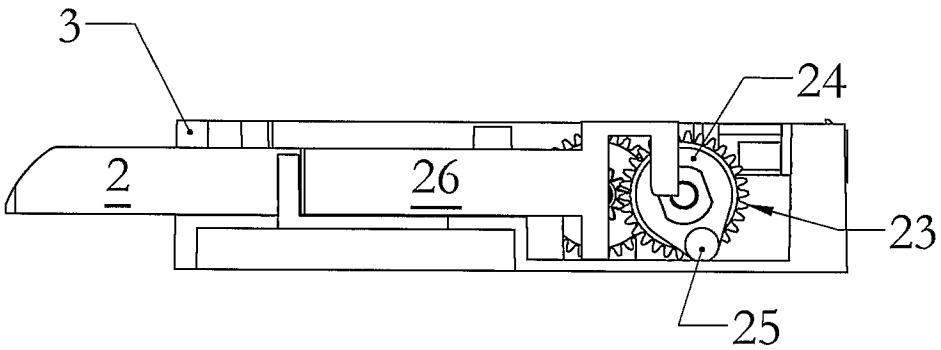
FIG. 4 is a cutaway (i.e., cross-section) side view of a present exemplary slam latch subject matter such as otherwise represented in part by present FIG. 1.
Figure 5A:
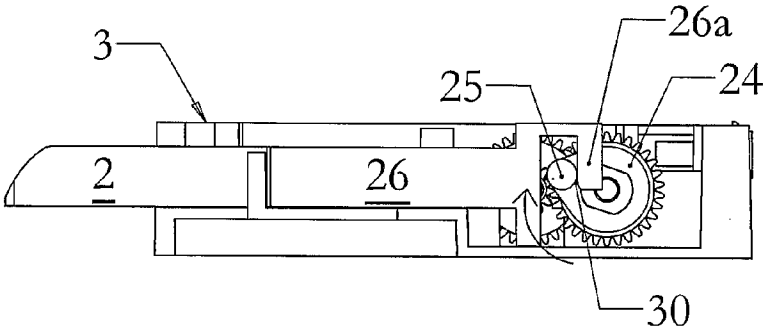
FIGS. 5*a* and 5*b* are cutaway views similar to present FIGS. 4 and 3, respectively, showing an output cam pin beginning to pull in an exemplary slide, all in accordance with present subject matter.
Figure 5B:
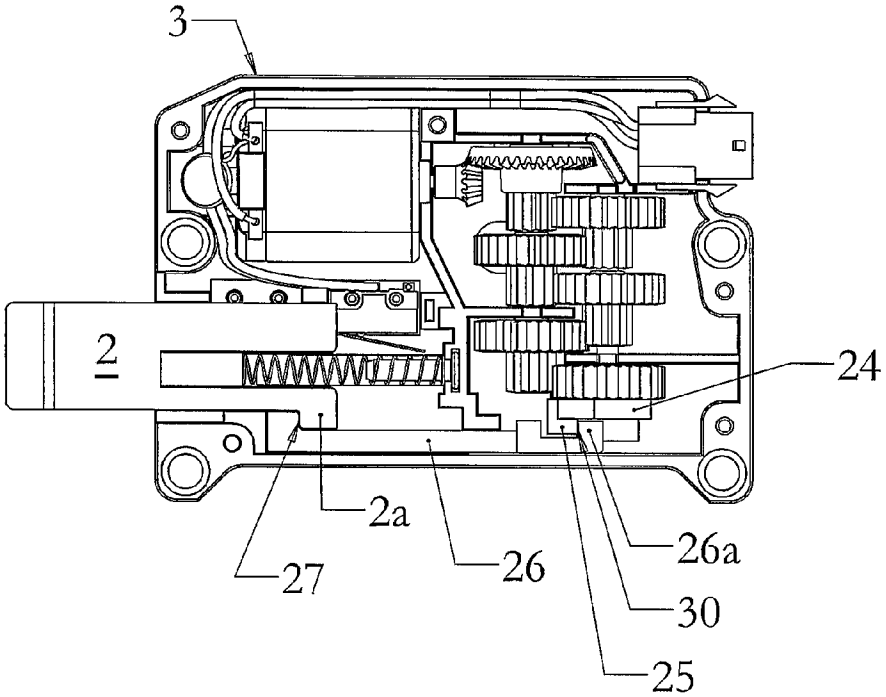

More particularly, FIG. 4 illustrates slam latch 100 in a "ready" state thereof, before power has been supplied to motor 15. Upon activation of motor 15 and subsequent rotation of the presently described exemplary gear train, output cam 24 and the coupled output pin 25 are rotated to the position shown in FIGS. 5*a* and 5*b*. At such point in time, output pin 25 engages slide 26 via tab 26*a* at point 30, and begins to retract slide 26. As slide 26 retracts, it in turn retracts slam bolt 2 via contact with the slam bolt tab 2*a* at point 27, as shown in FIG. 5*b*.

Figure 6:
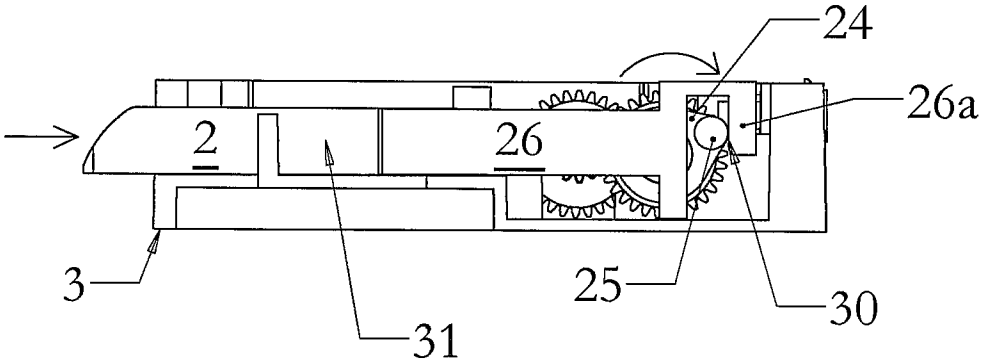
FIG. 6 is a cutaway side view of an exemplary slam latch per an illustration similar in view to that illustrated in present FIG. 4, and showing an exemplary output cam pin having completely retracted the slide, in accordance with present subject matter.

FIG. 6 is a cutaway side view of an exemplary slam latch per an illustration similar in view to that illustrated in present FIG. 4, and showing an exemplary output cam pin having completely retracted the slide, in accordance with present subject matter. More particularly, present FIG. 6 illustrates slam bolt 2 fully retracted, thereby creating gap 31 between slide 26 and the interior wall of housing 3.

Figure 7A:
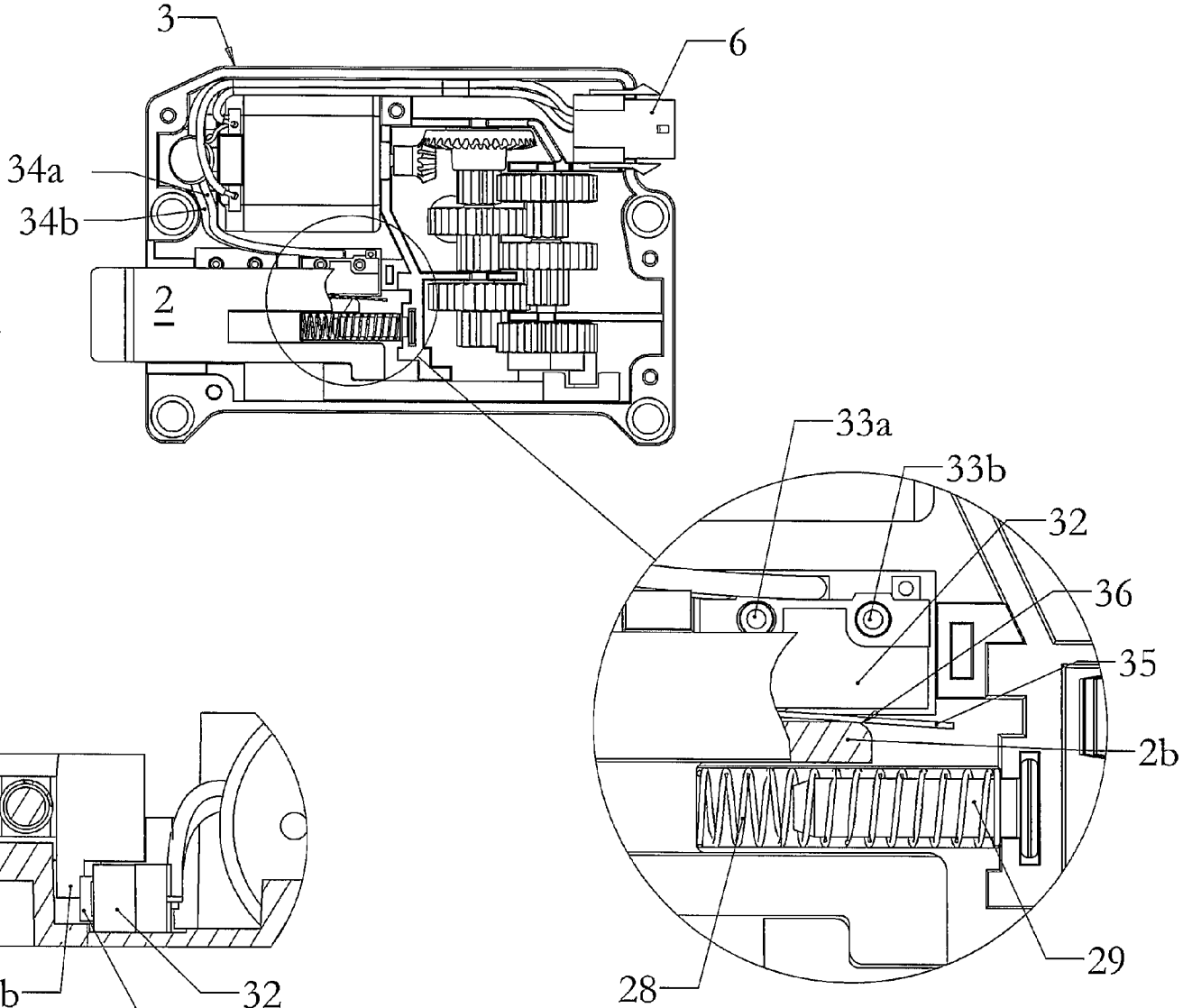
FIG. 7*a* illustrates a partial cutaway, side view of the exemplary slam latch subject matter of present FIG. 1, illustrated similar in view to that as in present FIG. 3, so as to reveal the internal construction of such exemplary slam latch, constructed in accordance with the present-subject matter, but shown with the exemplary slam bolt thereof in a retracted position, and showing one indicated portion thereof in a removed and enlarged circular view thereof; and with FIG. 7*b* separately illustrating in isolation and relative enlargement various latch retraction feedback switch and corresponding actuator features of such FIG. 7*a* exemplary embodiment.
Figure 7B:
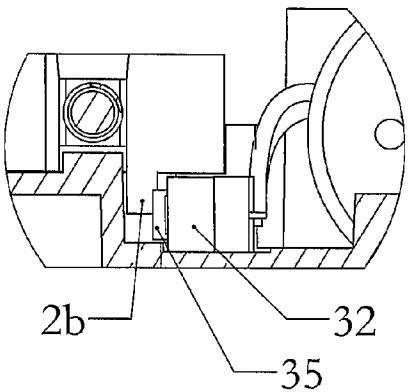

FIG. 7*a* illustrates a partial cutaway, side view of the exemplary slam latch subject matter of present FIG. 1, illustrated similar in view to that as in present FIG. 3, so as to reveal the internal construction of such exemplary slam latch, constructed in accordance with the present subject matter, but shown with the exemplary slam bolt thereof in a retracted position. One portion of such FIG. 7*a*, as indicated, is illustrated in a removed and enlarged circular view thereof. FIG. 7*b* separately illustrates in isolation and relative enlargement various latch retraction feedback switch and corresponding actuator features of such FIG. 7*a* exemplary embodiment.

More particularly, FIGS. 7*a* and 7*b* illustrate that slam latch 100 is also provided with latch retracted feedback switch 32, the operational state of which (that is, whether slam latch 100 is in an open or closed state) is constantly monitored by the access control system. Latch retracted feedback switch 32 is located adjacent to posts 33*a* and 33*b* of housing 3, and is electrically connected to electrical connector 6 by internal wires 34*a* and 34*b*. Per present subject matter, slam bolt 2 is considered fully retracted when actuator 35 of the latch retracted feedback switch 32 is depressed by tab 2*b* on the underside of slam bolt 2 at contact point 36. Motor 15 is then turned off by the access control system. FIG. 7*a* also illustrates that spring 28, held in place by spring guide 29, has been charged as the slam bolt 2 was retracted. Slam latch 100 is during such condition in the unlocked or open state, per present subject matter.

Figure 8:
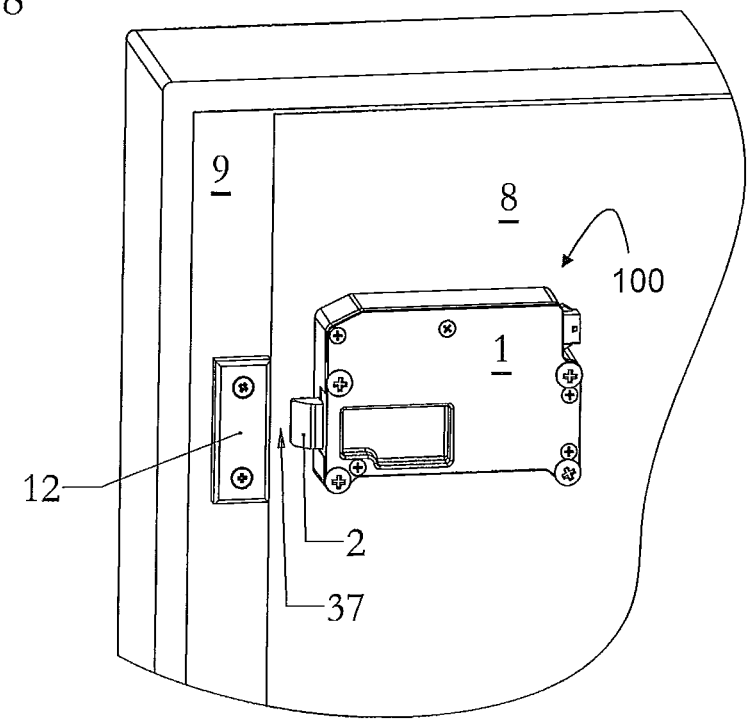
FIG. 8 illustrates the exemplary slam latch of present FIG. 1, in an exemplary installment thereof on an enclosure, illustrated with the slam bolt retracted, and the exemplary associated enclosure correspondingly unlocked.
Figure 9:
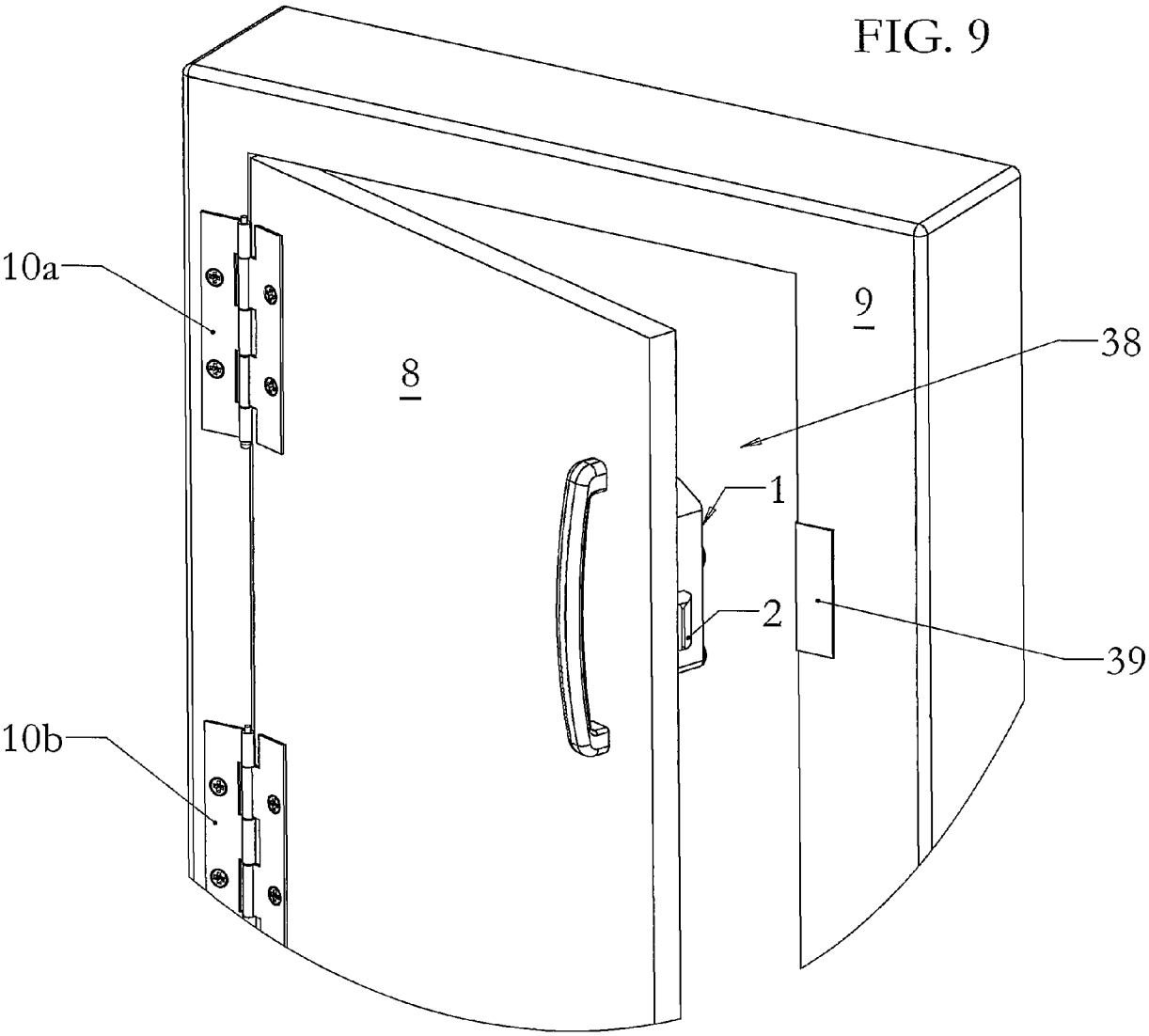
FIG. 9 is a generally front and partial side view of the exemplary enclosure of present FIG. 8 with the door of the associated enclosure open.

Motor 15 will remain off per present subject matter during an open delay period pre-programmed into the access control system. In FIG. 8, slam latch generally 100 is illustrated in a presently defined unlocked position thereof. FIG. 8 is identical to FIG. 2 except slam bolt 2 is in its presently defined retracted position, creating gap 37 between slam bolt 2 and strike 12. The exemplary cabinet (or enclosure) door 8 may in such condition be opened, creating gap 38 as shown in present FIG. 9.

Figure 10:
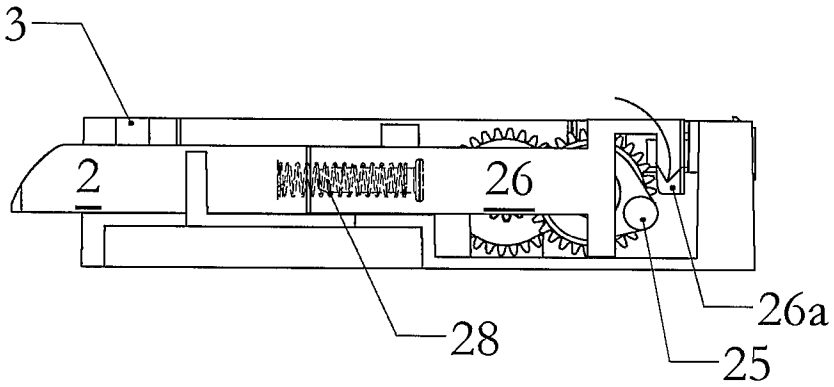
FIG. 10 is a cutaway side view of an exemplary slam latch similar in view to that as illustrated in present FIG. 6 but showing the exemplary output cam pin thereof slightly rotated and releasing the slide, per the present subject matter.
Figure 11:
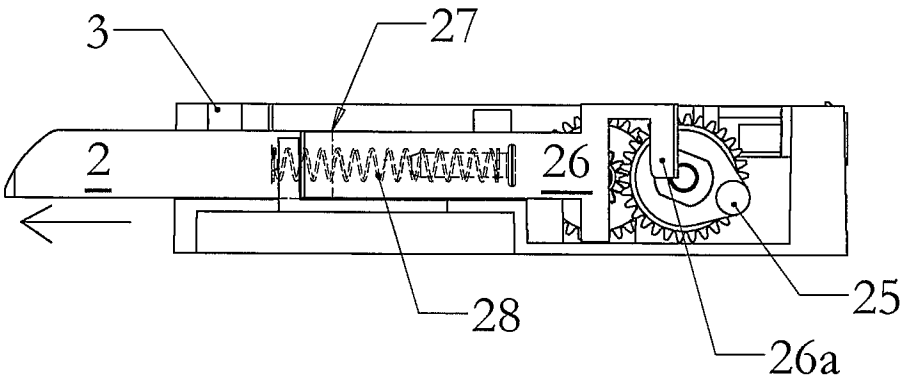
FIG. 11 is a cutaway side view of an exemplary slam latch similar in view to that as illustrated in present FIG. 10 but showing the exemplary slide thereof pushed forward, per the present subject matter

At the expiration of such pre-programmed delay period in the access control system, motor 15 is once again energized. FIG. 10 illustrates the position of the output cam pin 25 just after rotation thereof clear of slide tab 26*a*. Since there is no longer interference between output cam pin 25 and tab 26*a*, slam bolt 2 extends back out of the slam latch 100 by the extension of previously charged spring 28 (as shown in FIG. 11). Such action also pulls slide 26 in a presently defined forward direction via contact at point 27. Slam bolt 2 has thereby been returned to the presently defined extended or locked state thereof. It should be further noted that under such conditions, slam bolt 2 is free to travel in and out of slam latch 100, if so acted upon by external forces.

Figure 12A:
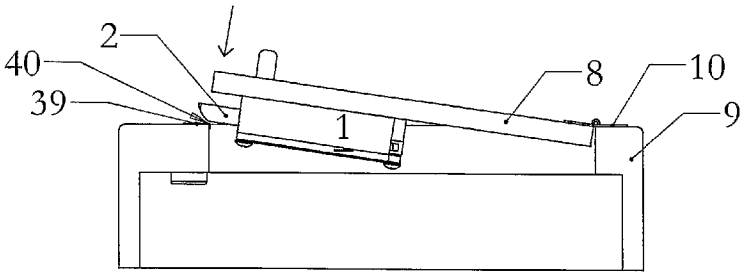
FIGS. 12*a*, 12*b*, and 12*c* illustrate respectively various exemplary aspects of the slam action of an exemplary slam latch constructed in accordance with the present subject matter.
Figure 12B:
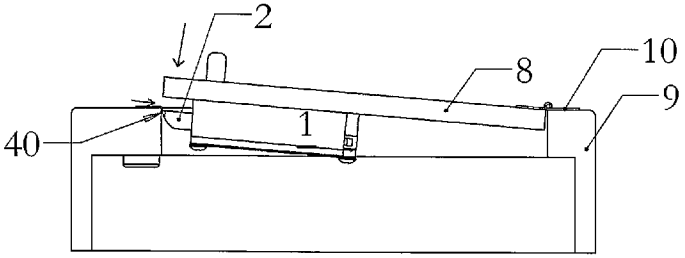
Figure 12C:
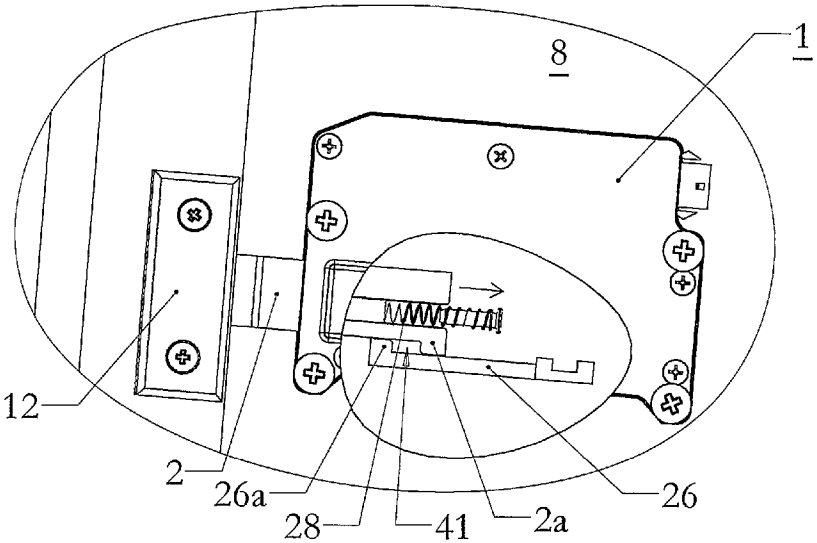

FIGS. 12*a*, 12*b*, and 12*c* illustrate respectively various exemplary aspects of the slam action of an exemplary slam latch constructed in accordance with the present subject matter. More particularly, such FIGS. 12*a*, 12*b*, and 12*c* illustrate the slam action capability of the latch, allowing the exemplary cabinet (or enclosure) door 8 to be automatically relocked upon closing.

More specifically, FIG. 12*a* illustrates the beginning of the presently disclosed slam action, in accordance with present subject matter. The closing of exemplary enclosure or cabinet door 8 causes the cam surface of slam bolt 2 to contact strike plate 39 at point 40. Such action forces exemplary slam bolt 2 into present exemplary slam latch 100, charging spring 28. The next stage of the re-locking sequence of events or stages is illustrated in FIG. 12*b* as the slam bolt 2 and slam latch 100 are in the process of clearing the cabinet frame 9. FIG. 12*c* illustrates that the action of slam bolt 2 has not affected the position of slide 26. Tab 2*a* of slam bolt 2 is disengaged from slide tab 26*a*, thereby creating the indicated gap 41.

Figure 13:
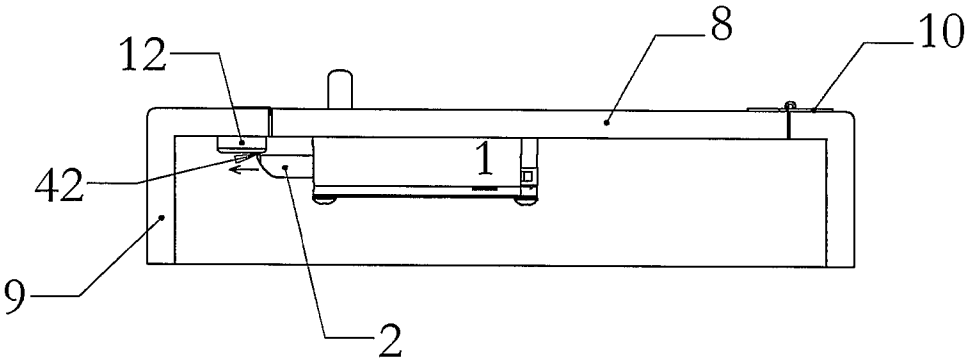
FIG. 13 illustrates a top view of an exemplary slam latch mounted to an enclosure door, and with the exemplary lock bolt thereof extended, for correspondingly locking the enclosure.

FIG. 13 illustrates the re-locking of an exemplary cabinet or enclosure. More particularly, FIG. 13 illustrates a top view of an exemplary slam latch mounted to an enclosure door, and with the exemplary lock bolt thereof extended, for correspondingly locking such exemplary enclosure. Slam bolt 2 has entirely cleared cabinet frame 9 and is then re-extended from slam latch 1 by the charged spring 28. The cabinet door 8 is secured in the presently defined locked position thereof by the interference action between slam bolt 2 and strike 12 at point 42.

Figure 14:
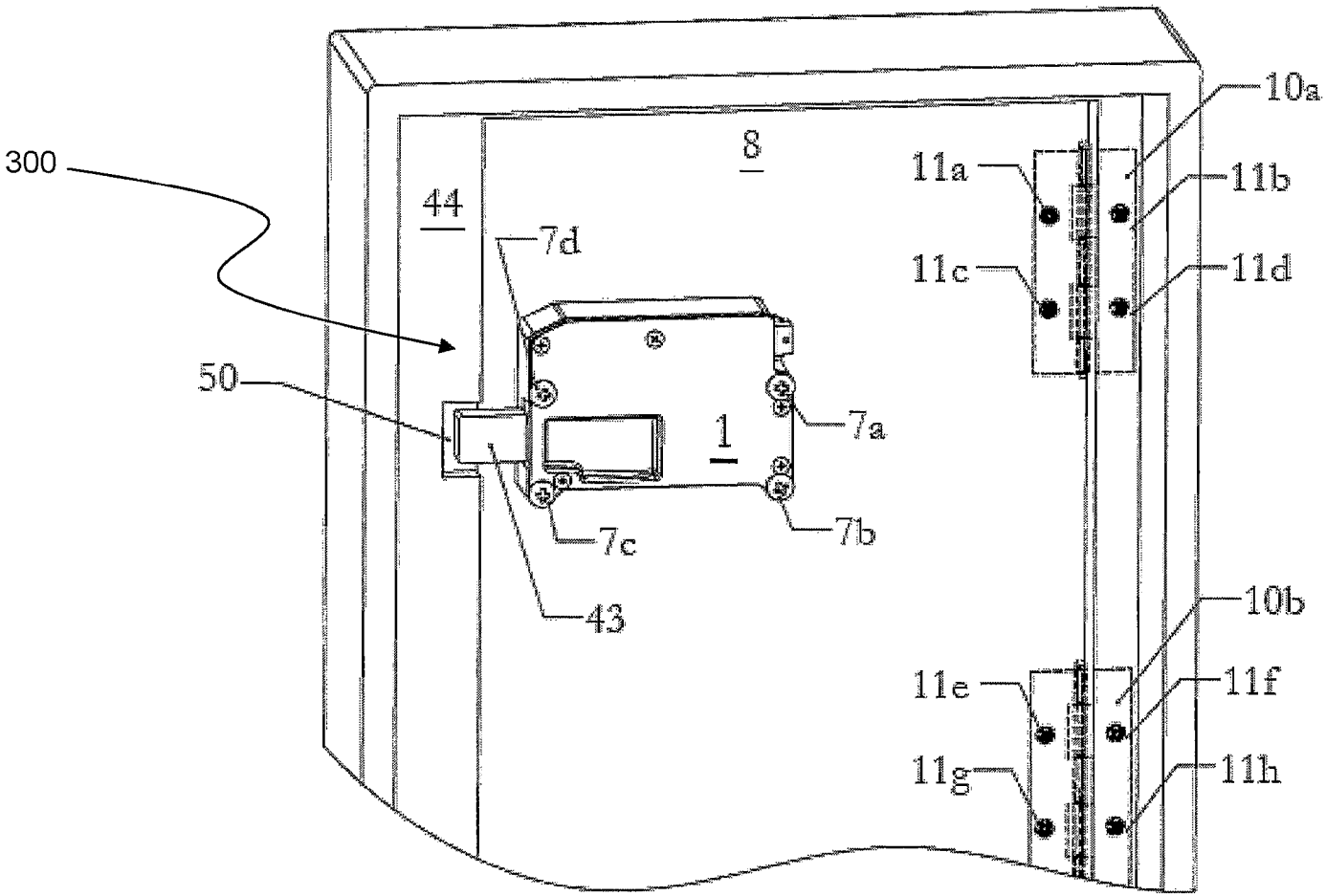
FIG. 14 illustrates an exemplary dead bolt latch configuration in accordance with a second exemplary embodiment of the present subject matter, and installed on an enclosure with an exemplary door closed, the dead bolt extended, and the enclosure locked.

FIG. 14 illustrates a second embodiment of the present subject matter embodied as dead bolt latch 300, mounted in a cabinet as seen from inside the cabinet. Such exemplary dead bolt latch configuration in accordance with a second exemplary embodiment of the present subject matter, is shown in such present FIG. 14 as installed on an exemplary enclosure with an exemplary door closed, the dead bolt extended, and the enclosure locked;

The exemplary cabinet per the present FIG. 14 illustration includes a door 8 which is rotationally secured to cabinet frame 44 with hinges 10*a*, 10*b*. As with the first embodiment of the present subject matter, hinges 10*a*, 10*b* may be secured to cabinet door 8 and cabinet frame 9 by screws 11*a*, 11*b*, 11*c*, 11*d*, 11*e*, 11*f*, 11*g*, and 11*h* or by other suitable means. Further, in accordance with the present subject matter, dead bolt latch 300 may be secured to door 8 with screws 7*a*, 7*b*, 7*c*, and 7*d* or by other suitable means. Door 8 is preferably secured in the presently defined closed position thereof by the interaction of dead bolt 43 and recessed area 50 in cabinet frame 44.

Figure 15:
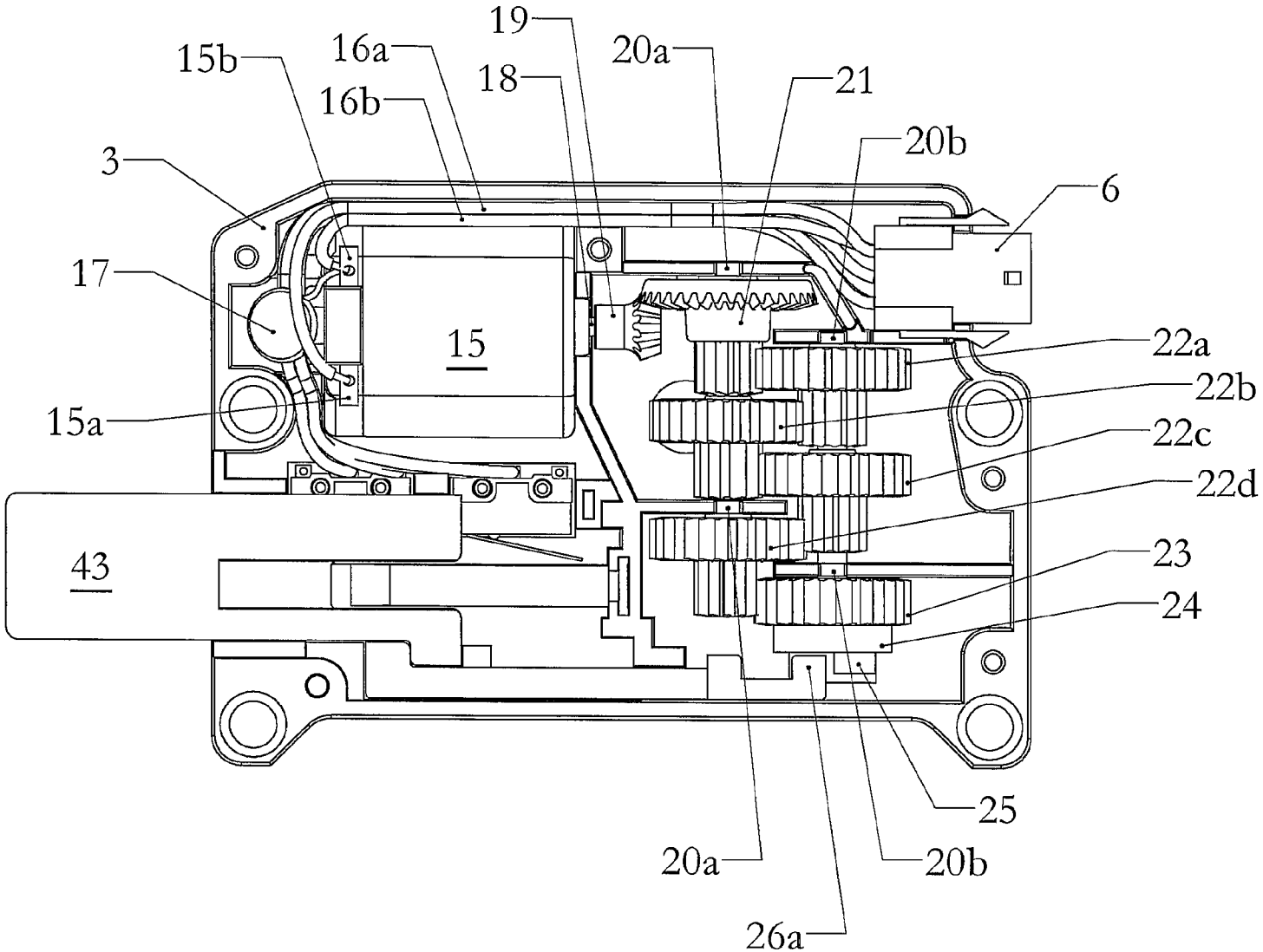
FIG. 15 illustrates an enlarged, partial cutaway, side view of the exemplary dead bolt latch subject matter of present FIG. 14, so as to reveal the internal construction of such exemplary dead bolt latch, constructed in accordance with the present subject matter, and shown with the exemplary dead bolt thereof in an extended position.

FIG. 15 illustrates an enlarged, partial cutaway, side view of the exemplary dead bolt latch subject matter generally 300 of present FIG. 14, so as to reveal the internal construction of such exemplary dead bolt latch, constructed in accordance with the present subject matter. The exemplary dead bolt thereof in shown in its presently defined extended position.

As represented by present FIG. 15, dead bolt latch generally 300 includes multiple components whose purpose is to alternately and selectively retract and extend dead bolt 43. The prime mover in dead bolt latch 300 is exemplary motor 15. In this embodiment, motor 15 is a permanent magnet DC motor. However, other various types of motors or prime movers may also be employed. Motor 15 is contained by a cavity within housing 3 and is provided with exemplary pinion gear 19 which is pressed onto shaft 18 thereof. Pinion 19 drives bevel gear 21 which rotates on shaft 20*a* bounded by slotted walls in housing 3. Bevel gear 21 in turn drives a series of spur gears 22*a*, 22*b*, 22*c*, 22*d*, and 23. Gears 22*b* and 22*d* also rotate on shaft 20*a*. Gears 22*a*, 22*c*, and 23 rotate on shaft 20*b* which is also bounded by slotted walls in housing 3. Such gear train operates in a manner substantially identically to that of the first exemplary embodiment, for the purposes of providing reduced speed and increased output torque from motor 15.

Motor 15 of the second exemplary embodiment of the present subject matter may also be controlled by a microprocessor based access control system. The access control system is electrically connected to dead bolt latch 300 through electrical connector 6. Again, it should be appreciated that other types of control systems may be employed in place of or in addition to the mentioned microprocessor based access control system.

Upon a valid credential or biometric being presented to the access control system, power is supplied to motor 15 by solid state motor controls and/or electrical relays through connector 6 and the related wiring. Electrical connector 6 is connected to motor 15 through motor wires 16*a* and 16*b* which are soldered or otherwise appropriately connected to motor 15 at terminals 15*a*, 15*b*. Further, such embodiment of the present subject matter may also be provided with electrical interference suppression device 17, connected to terminals 15*a*, 15*b* which may, as in the first embodiment, correspond to a capacitor. Upon energization, motor 15 rotates gear 19, which in turn rotates gears 21, 22*a*, 22*b*, 22*c*, 22*d*, and 23. The final gear of the gear train, gear 23, is coupled with output cam 24 which is provided with output cam pin 25.

Figure 16:
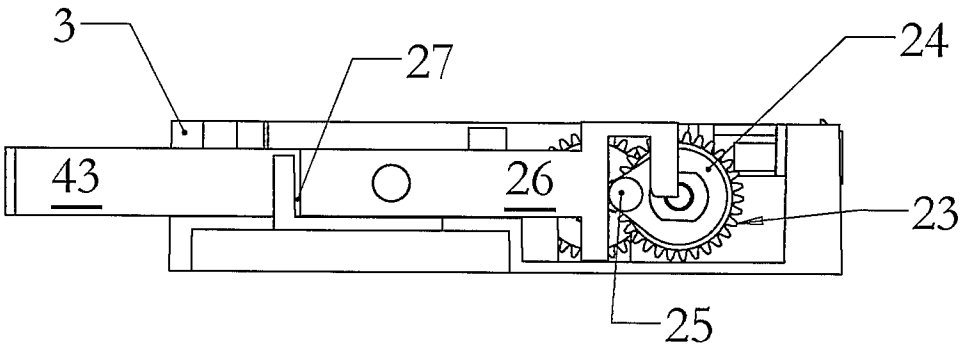
FIG. 16 is a cutaway (i.e., cross-section) side view of a present exemplary dead bolt latch subject matter such as otherwise represented in part by present FIG. 14.
Figure 17A:
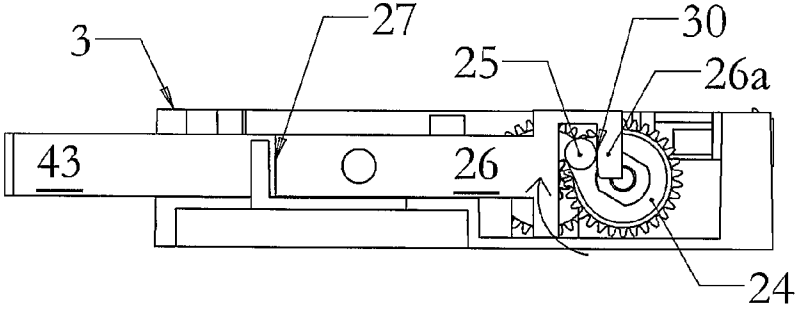
FIGS. 17*a* and 17*b* are cutaway views similar to present FIGS. 16 and 15, respectively, showing an output cam pin beginning to pull in an exemplary dead bolt, all in accordance with present subject matter.
Figure 17B:
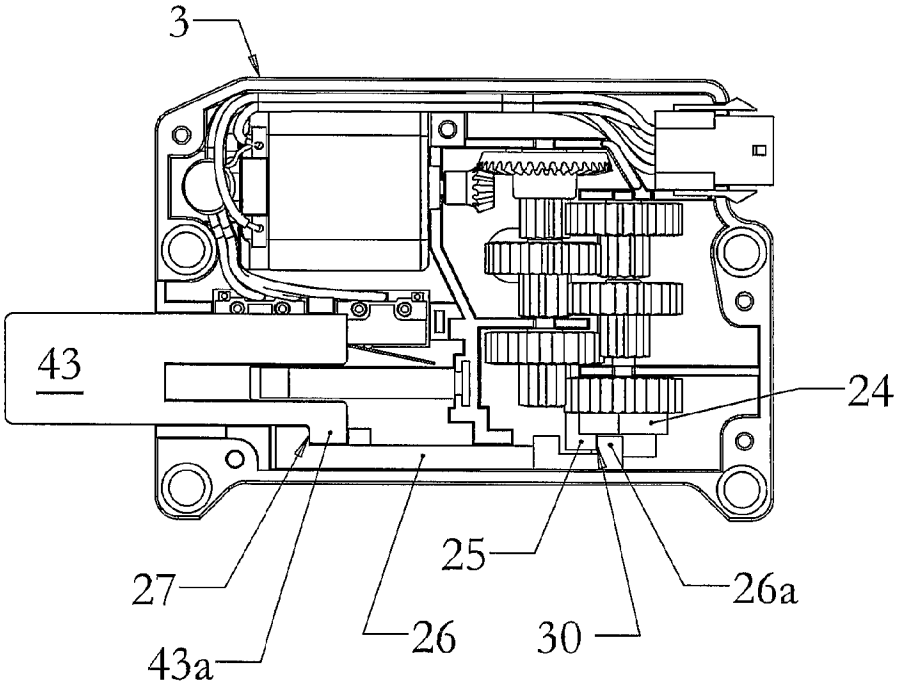
Figure 18:
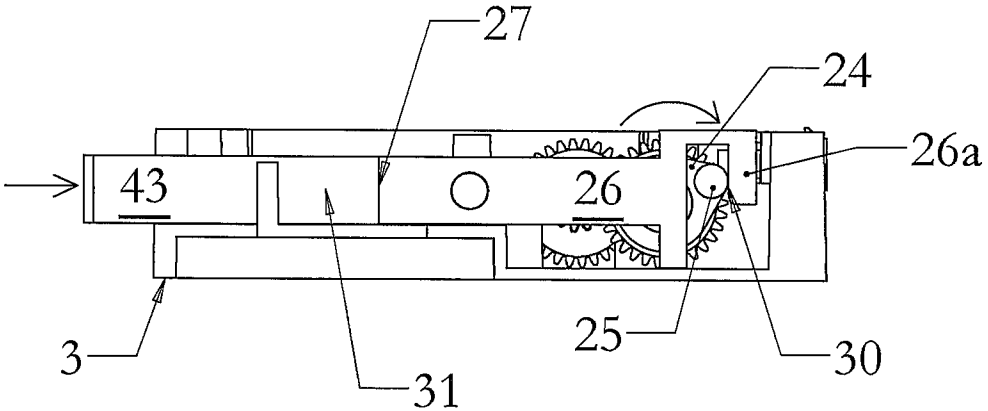
FIG. 18 is a cutaway side view of an exemplary dead bolt latch per an illustration similar in view to that illustrated in present FIG. 16, and showing an exemplary output cam pin having completely retracted the dead bolt slide, in accordance with present subject matter.

FIGS. 16, 17*a*, 17*b* and 18 variously illustrate the interaction of output cam pin 25 with slide 26. FIG. 16 illustrates exemplary dead bolt latch 300 in its presently defined "ready" state, before power has been supplied to motor 15. Upon activation of motor 15 and subsequent rotation of the exemplary gear train, output cam 24 and the coupled output pin 25 are rotated to the position such as shown in present FIG. 17*a*. At such point, output pin 25 engages slide 26 via tab 26*a* at point 30, so as to begin to retract slide 26. As slide 26 retracts, it in turn retracts dead bolt 43 via contact with dead bolt tab 43*a* at point 27, as shown in FIG. 17*b*. FIG. 18 illustrates dead bolt 43 in its presently defined fully retracted position, which per present subject matter creates gap 31 between slide 26 and the interior wall of housing 3.

Figure 19A:
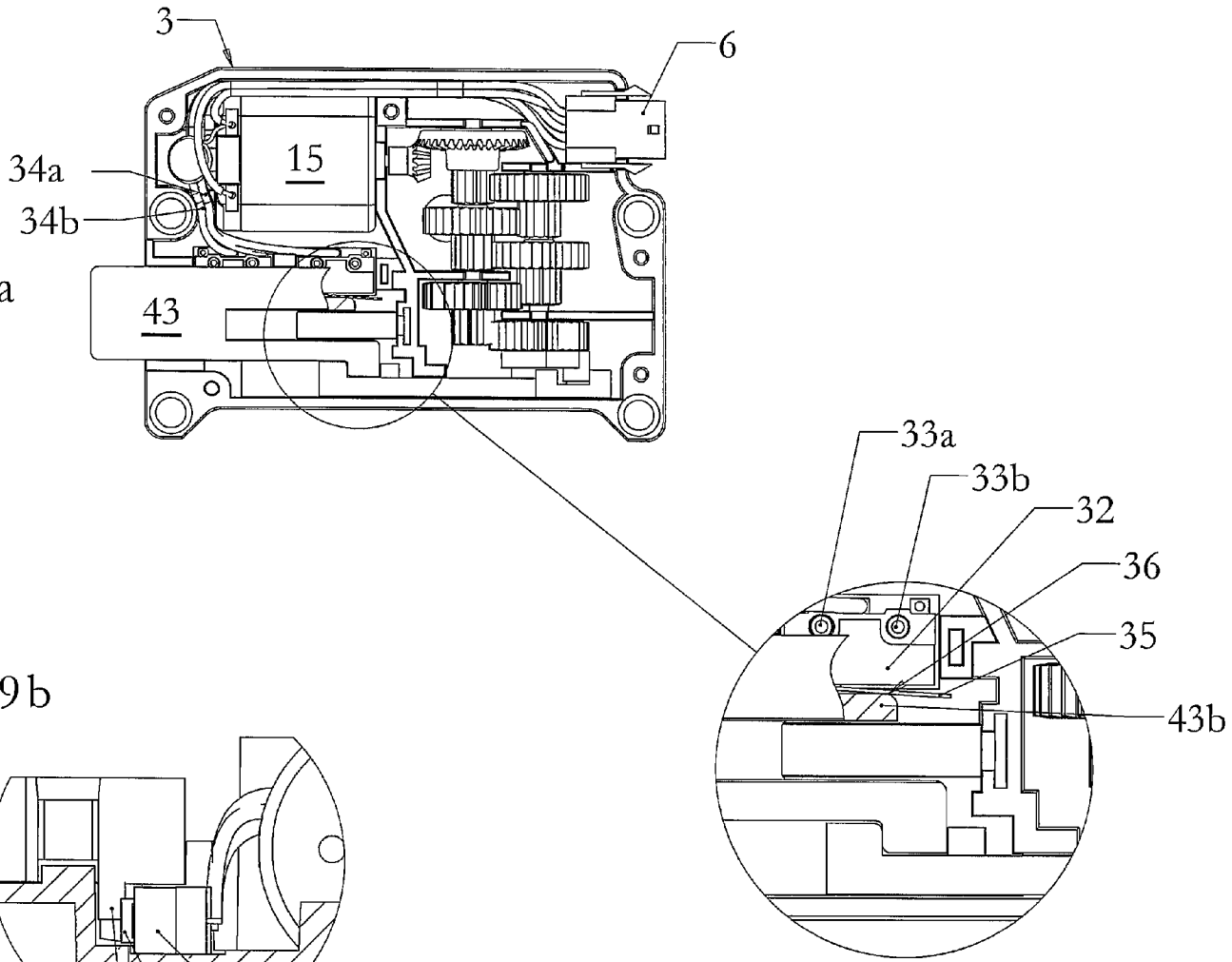
FIG. 19*a* illustrates a partial cutaway, side view of the exemplary dead bolt slam latch subject matter of present FIG. 14, illustrated similar in view to that as in present FIG. 15, so as to reveal the internal construction of such exemplary dead bolt latch, constructed in accordance with the present subject matter, but shown with the exemplary dead bolt thereof in a retracted position, and showing one indicated portion thereof in a removed and enlarged circular view thereof; and with FIG. 19*b* separately illustrating in isolation and relative enlargement various latch retraction feedback switch and corresponding actuator features of such FIG. 19*a* exemplary embodiment.
Figure 19B:
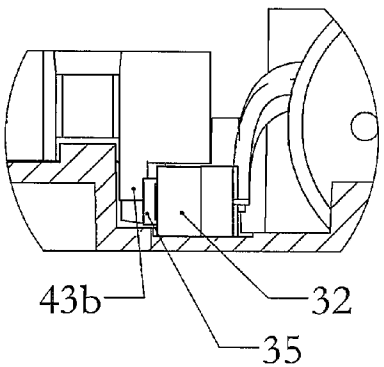

FIGS. 19*a* and 19*b* illustrate that dead bolt latch 300 is also provided with latch retracted feedback switch 32, the state of which is constantly monitored by the access control system. Latch retracted feedback switch 32 is located adjacent posts 33*a* and 33*b* of housing 3, and is electrically connected to electrical connector 6 by internal wires 34*a* and 34*b*. Dead bolt 43 is considered in its presently defined fully retracted position when actuator 35 of the latch retracted feedback switch 32 is depressed by tab 43*b* on the underside of dead bolt 43 at contact point 36. Motor 15 is then turned off by the access control system.

Dead bolt latch 300 is during such condition in its presently defined unlocked or open state. The latch will remain in such state until closed by the access control system, typically after receiving an additional input from the entrant (that is, the authorized person seeking to access the enclosure).

Figure 20:
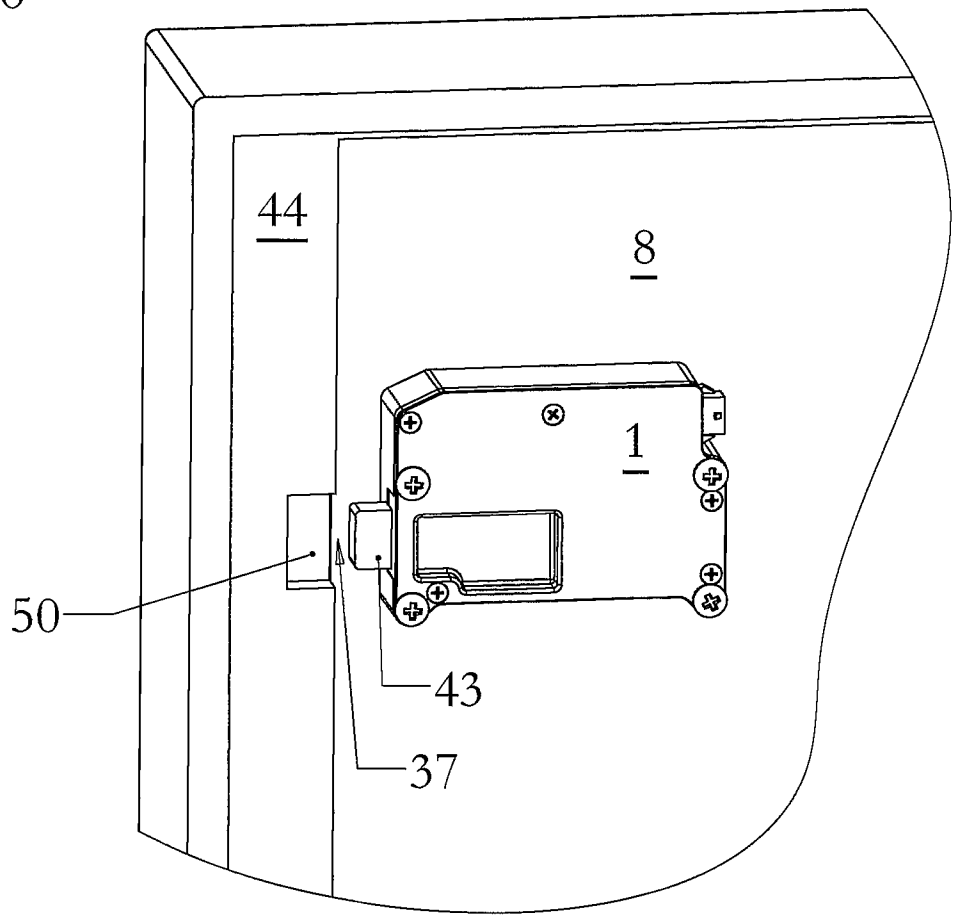
FIG. 20 illustrates the exemplary dead bolt latch of present FIG. 14, in an exemplary installment thereof on an enclosure, illustrated with the dead bolt retracted, and the exemplary associated enclosure correspondingly unlocked.

FIG. 20 illustrates the exemplary dead bolt latch of present FIG. 14, in an exemplary installment thereof on an enclosure, illustrated with the dead bolt in its presently defined retracted position. Such condition also means that the exemplary associated enclosure is correspondingly in its presently defined unlocked position.

Figure 21:
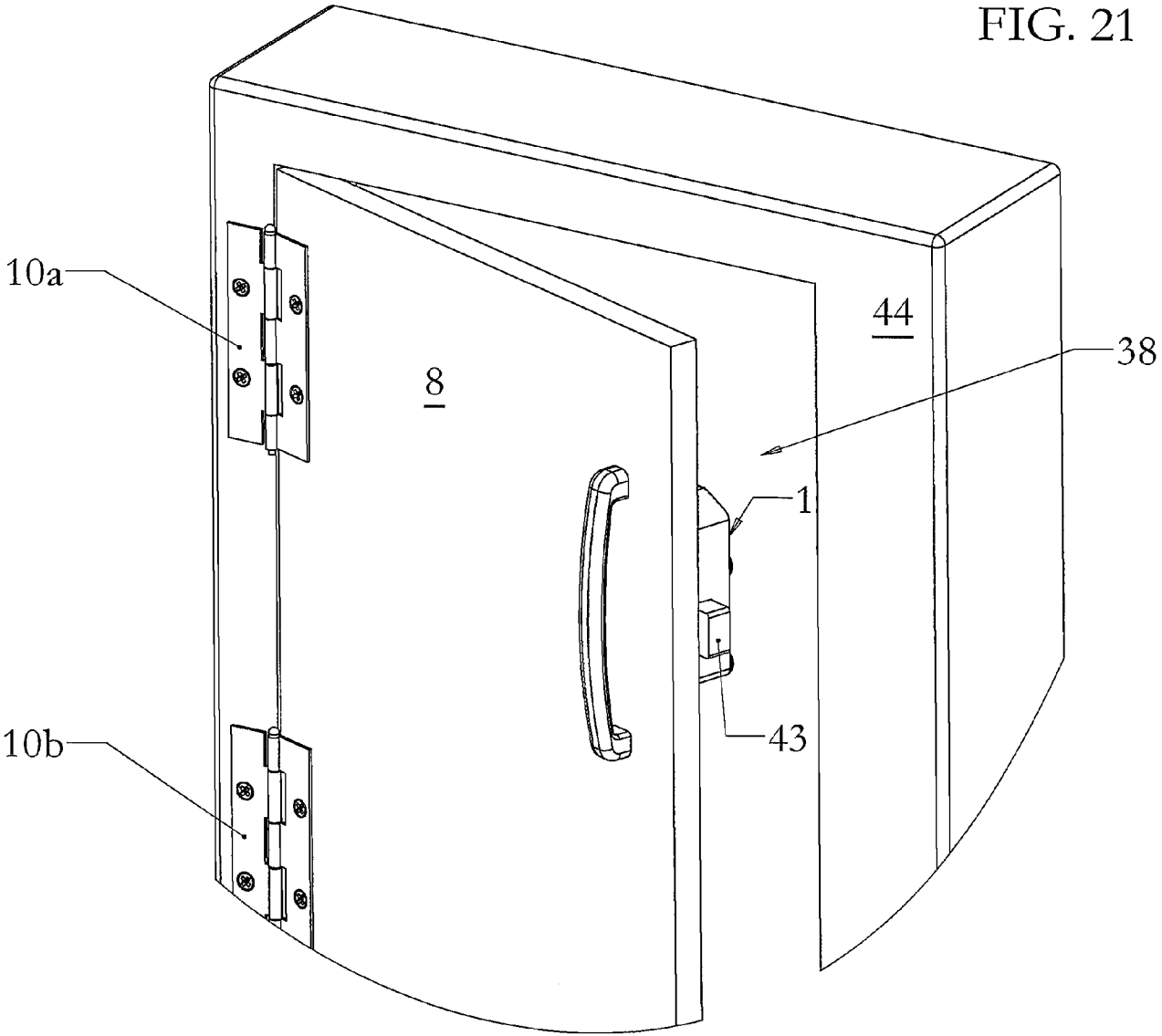
FIG. 21 is a generally front and partial side view of the exemplary enclosure of present FIG. 20 with the door of the associated enclosure open.

In FIG. 20, it is the dead bolt latch 300 which is illustrated in its unlocked position. FIG. 20 may otherwise be considered as being identical to FIG. 14 except that dead bolt 43 is in its presently defined retracted position, thereby creating gap 37 between dead bolt 43 and cabinet frame recess 50. Exemplary enclosure or cabinet door 8 may in such condition be opened, thereby creating gap 38 as shown in FIG. 21.

In the dead bolt latch embodiment of the present subject matter, dead bolt 43 is fixed to the present gear train and thus not capable of slamming shut as in the slam latch embodiment. It is therefore necessary for door 8 to be closed (as represented in present FIG. 22) before dead bolt 43 is extended. Upon closing of door 8, the access control system typically receives an input from one of a variety of sources including, but not limited to, user credential, push button, limit switch, or other authorized signal source, to energize motor 15 and extend dead bolt 43.

Figure 23:
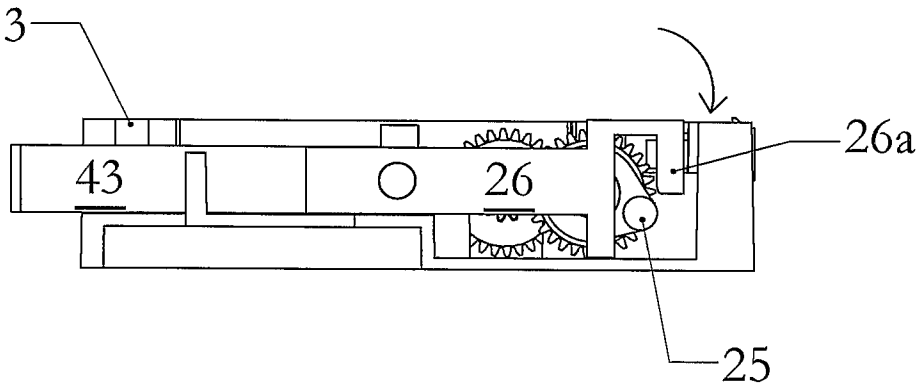
FIG. 23 is a cutaway side view of an exemplary dead bolt latch, illustrated similar in view to that as in present FIG. 10, showing the output cam pin slightly rotated and releasing the dead bolt slide, per the present subject matter.

FIG. 23 is a cutaway side view of an exemplary dead bolt latch, illustrated similar in view to that as in present FIG. 10, showing the output cam pin slightly rotated and releasing the dead bolt slide, per the present subject matter. More particularly, FIG. 23 illustrates the position of output cam pin 25 just after rotating clear of slide tab 26*a*. The position of slide 26 is no longer restricted by output cam pin 25 and is thus free to float within the dead bolt latch 300.

Figure 24A:
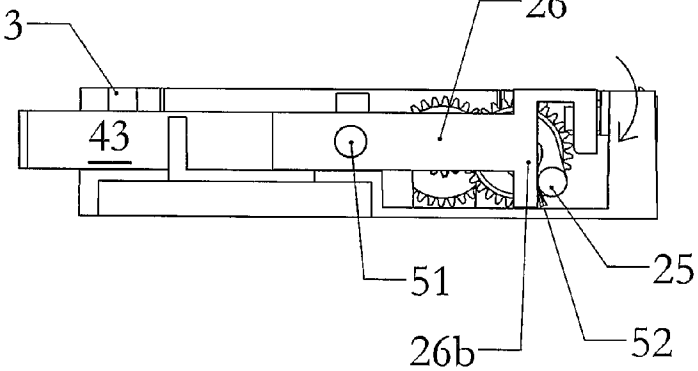
FIGS. 24*a* and 24*b* illustrate respectively various exemplary aspects of the dead bolt action of an exemplary dead bolt latch constructed in accordance with the present subject matter, including but not limited to, illustration of the output cam pin beginning to extend the exemplary slide and dead bolt, per present subject matter.
Figure 24B:
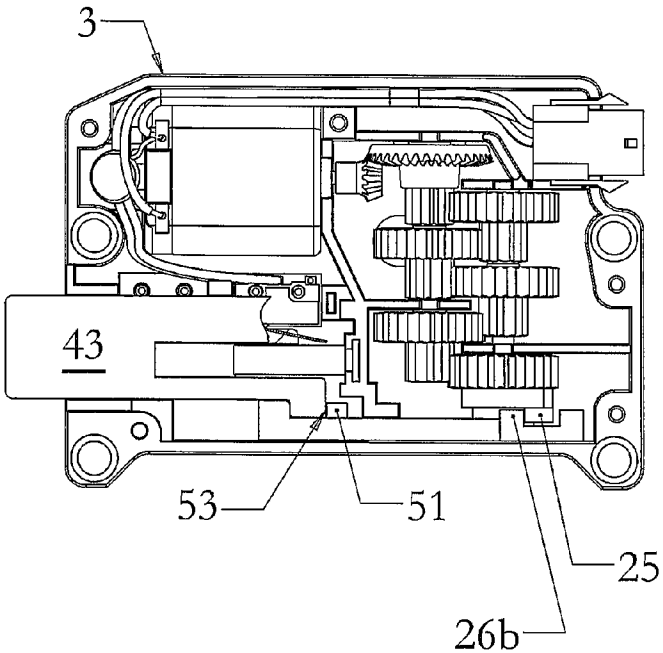
Figure 25:
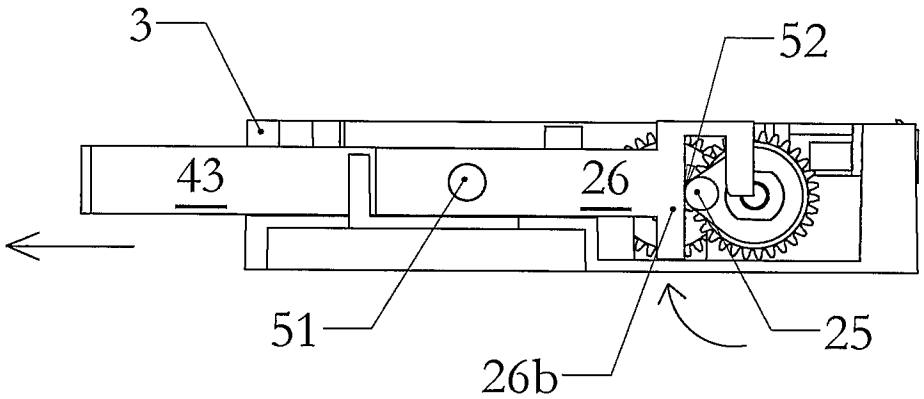
FIG. 25 illustrates the output cam pin completing the extension of the slide and dead bolt.

FIGS. 24*a* and 24*b* illustrate respectively various exemplary aspects of the dead bolt action of an exemplary dead bolt latch constructed in accordance with the present subject matter, including but not limited to, illustration of the output cam pin beginning to extend the exemplary slide and dead bolt, per present subject matter. More specifically, FIG. 24*a* illustrates output cam pin 25 after continuing to rotate and then contacting tab 26*b* of slide 26 at point 52. As output cam pin 25 continues to rotate, slide 26 is pushed in a presently defined forward direction, which in turn extends dead bolt 43 via contact with dead bolt pin 51 at point 53. Dead bolt pin 51 is perpendicularly inserted into slide 26 in the dead bolt latch embodiment for such purpose as opposed to the slam latch embodiment in which a spring provides for the extend action. FIG. 25 illustrates dead bolt 43 in its presently defined fully extended position.

Figure 26:
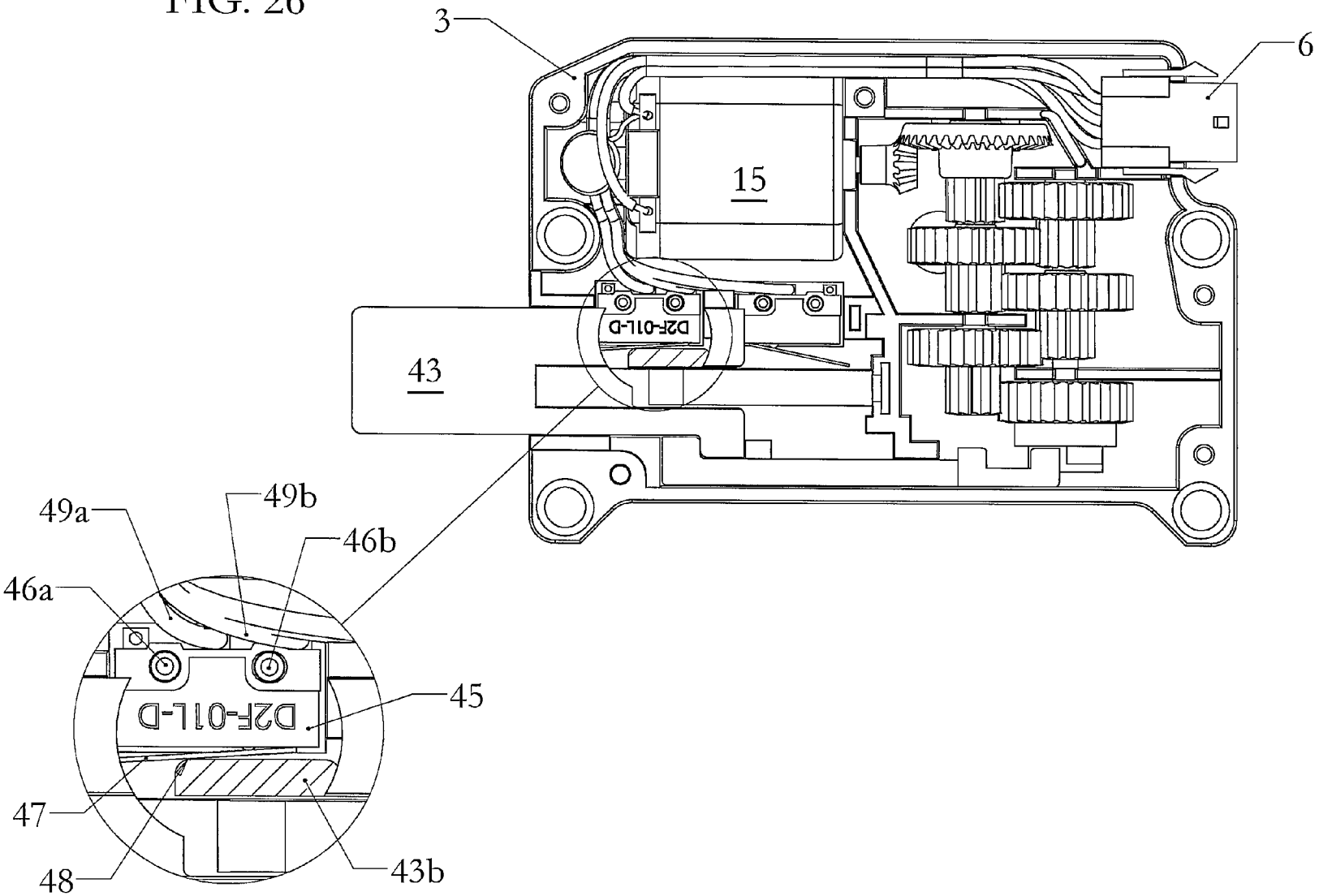
FIG. 26 illustrates an enlarged, partial cutaway, side view of the exemplary dead bolt latch subject matter of present FIG. 14, similar in view to that of present FIG. 15, so as to reveal the internal construction of such exemplary dead bolt latch, constructed in accordance with the present subject matter, and shown with additional highlighting of various features associated with the latch extended feedback switch thereof.

FIG. 26 illustrates an enlarged, partial cutaway, side view of the exemplary dead bolt latch subject matter of present FIG. 14, similar in view to that of present FIG. 15, so as to reveal the internal construction of such exemplary dead bolt latch, constructed in accordance with the present subject matter. FIG. 26 illustrates additional highlighting of various features associated with the latch extended feedback switch thereof. More specifically, FIG. 26 illustrates an exemplary means for providing an input to the access control system to turn off motor 15 once the dead bolt 43 has reached its presently defined fully extended position.

Continuing reference to present FIG. 26, in accordance with the present subject matter, dead bolt latch 300 is provided with a second switch (latch extended feedback switch 45) whose state (open/closed) is constantly monitored by the access control system. Latch extended feedback switch 45 is held in place by posts 46*a* and 46*b* of housing 3 and is electrically connected to electrical connector 6 by internal wires 49*a*, 49*b*. Latch extended feedback switch 45 is provided with an actuator 47 which is depressed by tab 43*b* of dead bolt 43 at point 48. When the access control system detects that the latch extended feedback switch 45 is closed, motor 15 is turned off.

Figure 22:
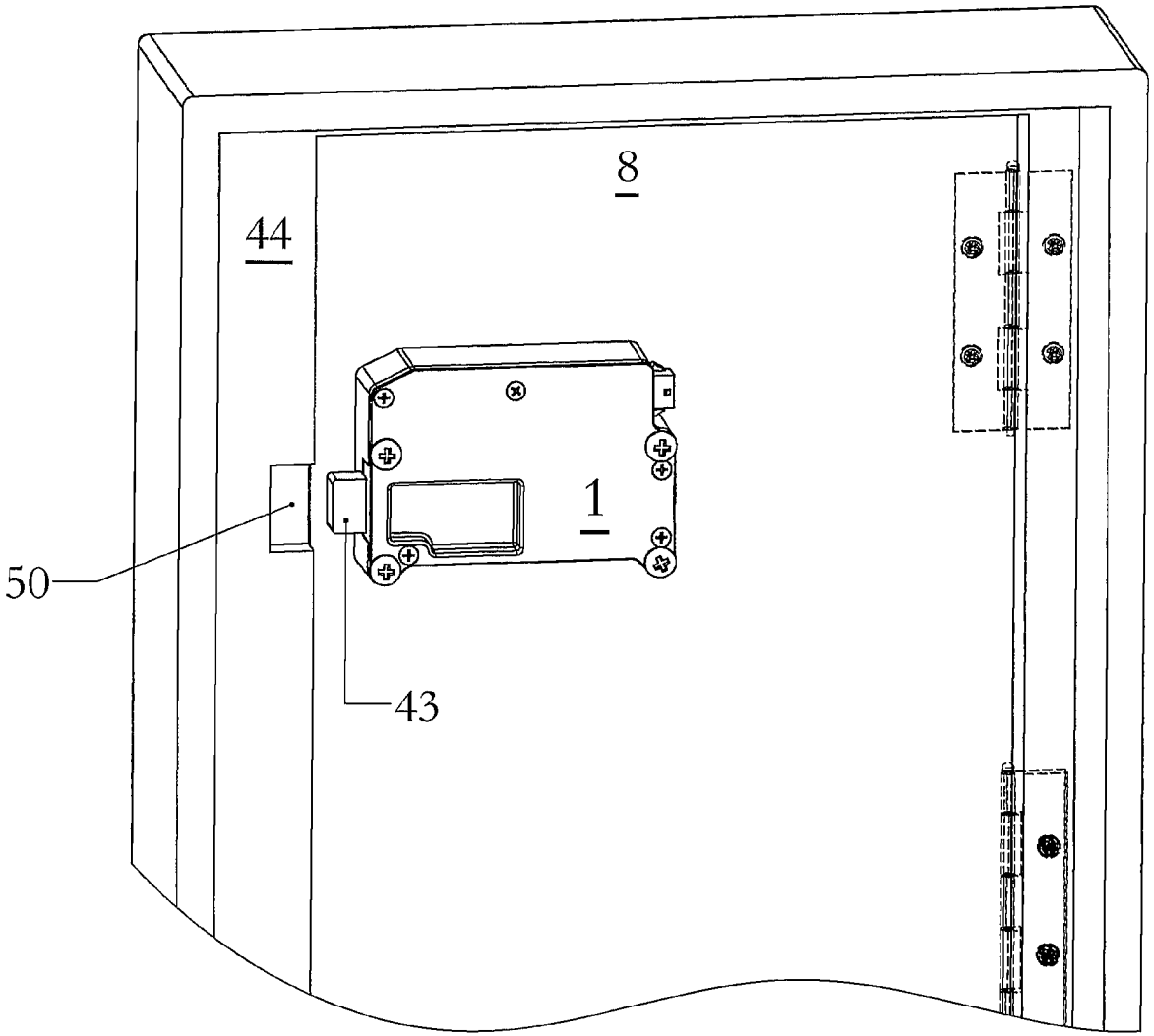
FIG. 22 illustrates an exemplary dead bolt latch configuration in accordance with a second exemplary embodiment of the present subject matter, illustrated similar in view to that as in present FIG. 14, and installed on an enclosure but with the exemplary door thereof open and the subject exemplary dead bolt retracted into the main latch body.
Figure 27:
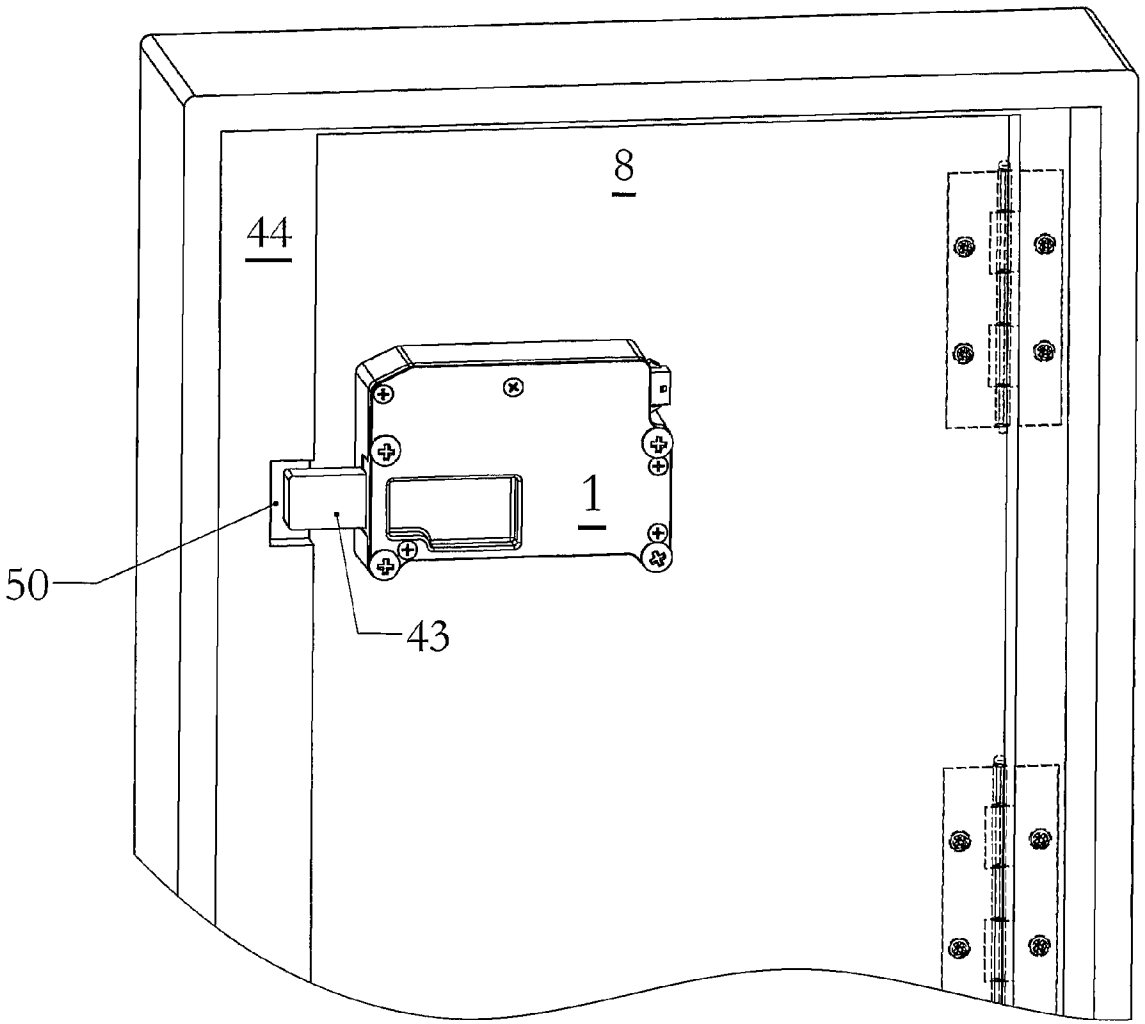
FIG. 27 illustrates an exemplary dead bolt latch configuration in accordance with a second exemplary embodiment of the present subject matter, illustrated similar in view to that as in present FIG. 22, and installed on an enclosure but with the exemplary door thereof closed and the subject exemplary dead bolt into a fully extended position into the main latch body, so that the exemplary closure is locked, all in accordance with the present subject matter.

FIG. 27 illustrates an exemplary dead bolt latch configuration in accordance with a second exemplary embodiment of the present subject matter, illustrated similar in view to that as in present FIG. 22, and installed on an enclosure but with the exemplary door thereof closed and the subject exemplary dead bolt into a fully extended position into the main latch body, so that the exemplary closure is locked, all in accordance with the present subject matter. FIG. 27 illustrates the exemplary cabinet door 8 secured in the locked position by the interference action between dead bolt 43 and cabinet frame 44 recessed area 50.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is intended by way of example rather than by way of limitation, and the subject disclosure does not preclude inclusion of such modifications, variations and/or additions to the present subject matter as would be readily apparent to one of ordinary skill in the art.

What is claimed is:

1. A method of providing controlled access to a cabinet of the type having an alternately openable and closeable door, the method comprising:

providing a convertible latch kit including components for selective assembly, said convertible latch kit including:

a housing;

an electrically operated drive mechanism mounted in said housing and having an associated drive mechanism output, said drive mechanism output having a gear train, an output cam, an output cam pin, a slide, and a slide tab coupled to said slide and configured for engagement with said cam pin;

a slam bolt configured to be mounted in said housing and to be retracted by the slide of said drive mechanism output;

a spring configured to be cooperatively engageable with said slam bolt to provide a force thereto in the direction of extending said slam bolt from said housing; and a dead bolt configured to be mounted in said housing and to be selectively alternately retracted and extended by the slide of said drive mechanism output;

determining whether such cabinet is of the type having an associated strike plate supported on a frame thereof, for use with a slam bolt configuration, or of the type having a recessed area formed in a frame thereof, for use with a dead bolt thereof;

depending on such determination, selecting accordingly either of such slam bolt or dead bolt, respectively, for inclusion in such housing;

mounting an electrical connector in such housing and configured to provide electrical connection to said electrically operated drive mechanism; and mounting such housing in such cabinet, supported on the door thereof and positioned so that the included bolt of such housing is interoperative with the frame of such cabinet for alternate locking and unlocking of the cabinet door.

2. A method as in claim 1, further comprising mounting at least one electrical switch in such housing and coupled to said electrical connector so as to sense movement of one of said slam bolt and said dead bolt mounted in said housing.

3. A method as in claim 2, further comprising mounting a second electrical switch in such housing and coupled to said electrical connector so as to further sense movement of one of said slam bolt and said dead bolt mounted in said housing.

4. A method as in claim 2, further including providing an external access control device attached to said electrical connector, for controlling said electrically operated drive mechanism for alternately unlocking and relocking said door through actuation of said drive mechanism, said control device including an automatic pre-programmed time delay for relocking said door after unlocking thereof.

* * * * *